US010974267B2

(12) United States Patent
Ophardt et al.

(10) Patent No.: US 10,974,267 B2
(45) Date of Patent: Apr. 13, 2021

(54) FRANGIBLE DIP TUBE

(71) Applicant: OP-Hygiene IP GmbH, Niederbipp (CH)

(72) Inventors: Heiner Ophardt, Arisdorf (CH); Padraig McDonagh, County Sligo (IE)

(73) Assignee: OP-Hygiene IP GmbH, Niederbipp (CH)

( * ) Notice: Subject to any disclaimer, the term of this patent is extended or adjusted under 35 U.S.C. 154(b) by 0 days.

(21) Appl. No.: 16/673,166

(22) Filed: Nov. 4, 2019

(65) Prior Publication Data

US 2020/0147626 A1 May 14, 2020

Related U.S. Application Data

(60) Provisional application No. 62/757,390, filed on Nov. 8, 2018.

(51) Int. Cl.

| | |
|---|---|
| ***B05B 11/00*** | (2006.01) |
| *B05B 15/30* | (2018.01) |
| *A47K 5/12* | (2006.01) |

(52) U.S. Cl.

CPC ..... *B05B 11/3047* (2013.01); *B05B 11/3011* (2013.01); *B05B 11/3014* (2013.01); *B05B 11/3023* (2013.01); *A47K 5/1205* (2013.01); *B05B 15/30* (2018.02)

(58) Field of Classification Search

CPC ..... B05B 11/3011; B05B 11/3023; B05B 11/3047; B05B 11/3014; B05B 11/3057; B05B 15/30; A47K 5/1205; A47K 5/1207

See application file for complete search history.

(56) References Cited

U.S. PATENT DOCUMENTS

| | | | | |
|---|---|---|---|---|
| 5,489,044 | A | 2/1996 | Ophardt | |
| 7,748,573 | B2 | 7/2010 | Ophardt et al. | |
| 7,984,825 | B2 | 7/2011 | Ophardt et al. | |
| 8,684,236 | B2 | 4/2014 | Ophardt | |
| 2006/0196885 | A1* | 9/2006 | Leach | A61M 11/06 222/82 |
| 2008/0121664 | A1* | 5/2008 | Ophardt | B05B 11/3001 222/321.9 |
| 2012/0234870 | A1* | 9/2012 | Good | B05B 11/0089 222/382 |

(Continued)

FOREIGN PATENT DOCUMENTS

| | | |
|---|---|---|
| EP | 3081312 | 10/2016 |
| JP | 2007091319 | 4/2007 |

(Continued)

*Primary Examiner* — Frederick C Nicolas

(74) *Attorney, Agent, or Firm* — Thorpe North & Western, LLP

(57) ABSTRACT

A dip tube for a fluid pump which dip tube includes at least one frangible portion which, when intact, provides different characteristics to the dip tube than when broken, including, for example, providing for shortening of the length of the dip tube and/or providing for an inlet opening at a closed a lower end of the dip tube. The dip tube is to be inserted into a fluid containing bottle such that on insertion a distal end of the dip tube comes into engagement with a bottom wall of the reservoir with forces arising in such engagement resulting in a breaking of the frangible portion causing a change of characteristics of the dip tube.

20 Claims, 21 Drawing Sheets

(56) References Cited

U.S. PATENT DOCUMENTS

| | | | | |
|---|---|---|---|---|
| 2015/0217314 | A1* | 8/2015 | Kharbanda | A47K 5/1201 222/1 |
| 2017/0100735 | A1* | 4/2017 | Taylor | B05B 11/3045 |
| 2019/0021470 | A1* | 1/2019 | Kim | A45D 34/04 |

FOREIGN PATENT DOCUMENTS

| | | |
|---|---|---|
| JP | 2011092830 | 5/2011 |
| NL | 8300993 | 10/1984 |

* cited by examiner

FRANGIBLE DIP TUBE

SCOPE OF THE INVENTION

This invention relates to a feed dip tube for a fluid pump for insertion into a fluid reservoir from which fluid is to be drawn by a pump through the dip tube.

BACKGROUND OF THE INVENTION

Various fluid dispensers are known with pump assemblies having a dip tube via which fluid in a reservoir may be drawn by a pump. Previously known dip tubes suffer the disadvantage that the dip tubes have a fixed length and, insofar as reservoirs are used having different lengths, then a dip tube of a corresponding length for each reservoir needs to be matched with and used with each reservoir. Providing dip tubes of different lengths has the disadvantage of increasing inventory and the number of different dip tube configurations in the inventory. Having an inventory of dip tubes of different lengths gives rise to the disadvantage of the risk of mis-matching in which a shorter dip tube than desired is inadvertently inserted into a bottle requiring a greater length dip tube. The mis-matching is not readily appreciated to a person assembling the dip tube and reservoir since the shorter dip tube will initially function with a pump assembly to draw liquid the reservoir, however, after liquid has been pumped from the reservoir, the disadvantage later arises that liquid remaining between the bottom of the bottle and the lower end of the dip tube will not be drawn out by the pump, and especially where the reservoir is for a single use and to be discarded after use, such remaining fluid is discarded also.

Known dip tubes also suffer disadvantages that a lower inlet end of the dip tube is always open and can be an access opening for contaminants prior to insertion into a reservoir.

Dip tubes are known which are intended for use but a single time and are to be being discarded after one use, however, known single use dip tubes do not provide an arrangement which indicates whether they have been previously used.

SUMMARY OF THE INVENTION

To at least partially overcome some of the disadvantages of previously known devices, the invention provides a dip tube for a fluid pump which dip tube includes at least one frangible portion which, when intact, provides different characteristics to the dip tube than when broken, including, for example, providing for shortening of the length of the dip tube and/or providing for an inlet opening at a closed a lower end of the dip tube.

To at least partially overcome some of the disadvantages of previously known devices, the present invention also provides a novel combination of a fluid reservoir and a dip tube to be inserted into the reservoir in which, on insertion of the dip tube into the reservoir, the dip tube comes into engagement with a bottom wall of the reservoir with forces arising in such engagement resulting in a change of characteristics of the dip tube.

To at least partially overcome some of the disadvantages of previously known devices, the present invention also provides a novel combination of a fluid dispenser, a fluid reservoir and a pump assembly including a pump and a dip tube coupled to the pump. The dip tube is insertable into the reservoir for communication with fluid contained therein, and the pump is operable to draw the fluid from the reservoir through the tube and dispense the fluid from a pump outlet.

Optionally, a locking member may be coupled to the dip tube and is configured to engage internally with the reservoir to prevent the dip tube from being extracted from the reservoir. The locking member may, for example, include one or more elongated fingers that, when in a locking configuration, extend radially outward from the dip tube, such that a distal end of the fingers engages with a stopping surface within the reservoir to prevent extraction of the dip tube. Preferably, the fingers can be deflected radially inward toward the tube to permit insertion of the locking member into the reservoir, and are biased to adopt the locking configuration once fully inserted into the reservoir.

Accordingly, in one aspect, the present invention provides a dip tube comprising:

an elongate hollow tubular member extending from an innermost inlet end to an outlet end, the tubular member having a circumferential tube wall, the tubular member having an outer tube portion, an intermediate tubular frangible portion, and an inner tube portion, the outer tube portion including the outlet end and extending from the outlet end to an intermediate inlet end on the outer tube portion, the inner tube portion including the innermost inlet end and extending from the innermost inlet end to an intermediate outlet end on the inner tube portion, the frangible portion bridging between the outer tube portion and the inner tube portion providing communication between the intermediate inlet end on the outer tube portion and the intermediate outer end on the inner tube portion, the frangible portion extending circumferentially about the tubular member, the frangible portion selected such that while the frangible portion is intact on the application of a threshold tension force between the inner tube portion and the outer tube portion across the frangible portion the frangible portion breaks, with the frangible portion intact, the tube wall defining a sealed continuous long interior passageway through each of the outer tube portion, the frangible portion and the inner tube portion of the tubular member between an outlet opening at the outlet end on the outer tube portion and the innermost inlet end on the inner tube portion, with the frangible portion broken the tube wall over the outer tube portion defining a sealed continuous short interior passageway through the outer tube portion between the outlet opening at the outlet end on the outer tube portion and an intermediate inlet opening at the intermediate inlet end on the outer tube portion, the intermediate inlet opening open through the tube wall of the outer tube portion at the intermediate inlet end.

In another aspect, the present invention resides in a pump assembly for dispensing fluid from a reservoir, comprising: a hollow dip tube for insertion into the reservoir through an outlet opening, the hollow dip tube having a first open end for communication with the fluid in the reservoir, and a second open end spaced from the first open end; and a pump coupled to the second end of the hollow dip tube, the pump being operable to draw the fluid from the reservoir through the hollow dip tube, and dispense the fluid from a discharge outlet.

In a further aspect, the present invention resides in a dip tube for use in conjunction with a pump for dispensing fluid from a reservoir, the dip tube comprising: a hollow tube body configured to be at least partially contained within the reservoir, the hollow tube body having a first open end for communication with the fluid in the reservoir, and a second open end for coupling to the pump.

In a still further aspect, the present invention resides in a method of assembling a fluid dispenser, comprising: providing a dip tube having a first end and a second end and inserting the first end of the dip tube into a fluid reservoir through an outlet opening of the fluid reservoir; preferably also coupling a pump to the second end of the dip tube.

In a $1^{st}$ feature, the present invention provides a dip tube comprising:

an elongate hollow tubular member extending from an innermost inlet end to an outlet end, the tubular member having a circumferential tube wall, the tube wall having an exterior surface and an interior surface and a thickness between the exterior surface and the interior surface, the tubular member having an outer tube portion, an intermediate tubular frangible portion, and an inner tube portion, the outer tube portion including the outlet end and extending from the outlet end to an intermediate inlet end on the outer tube portion, the inner tube portion including the innermost inlet end and extending from the innermost inlet end to an intermediate outlet end on the inner tube portion, the frangible portion bridging between the outer tube portion and the inner tube portion providing communication between the intermediate inlet end on the outer tube portion and the intermediate outer end on the inner tube portion, the frangible portion extending circumferentially about the tubular member, the frangible portion selected such that while the frangible portion is intact on the application of a threshold tension force between the inner tube portion and the outer tube portion across the frangible portion the frangible portion breaks, with the frangible portion intact, the interior surface of the tube wall defining a sealed continuous long interior passageway through each of the outer tube portion, the frangible portion and the inner tube portion of the tubular member between an outlet opening at the outlet end on the outer tube portion and the innermost inlet end on the inner tube portion, with the frangible portion broken the interior surface of the tube wall over the outer tube portion defining a sealed continuous short interior passageway through the outer tube portion between the outlet opening at the outlet end on the outer tube portion and an intermediate inlet opening at the intermediate inlet end on the outer tube portion, the intermediate inlet opening open through the tube wall of the outer tube portion to the exterior of the tube wall at the intermediate inlet end.

In a $2^{nd}$ feature, the present invention provides a dip tube as in the $1^{st}$ feature wherein the thickness of the tube wall over the frangible portion selected such that while the frangible portion is intact on the application of the threshold tension force between the inner tube portion and the outer tube portion across the frangible portion the frangible portion selectively breaks without the application of the threshold tension force between the inner tube portion and the outer tube portion damaging the inner tube portion and the outer tube portion.

In a $3^{rd}$ feature, the present invention provides a dip tube as in the $1^{st}$ or $2^{nd}$ feature wherein the thickness of the tube wall over the frangible portion is less than a thickness of the tube wall over any section of the outer tube portion and the inner tube portion.

In a $4^{th}$ feature, the present invention provides a dip tube as in the $1^{st}$, $2^{nd}$ or $3^{rd}$ feature wherein the frangible portion includes an annular groove extending radially inwardly into the tube wall from the exterior surface of the tube wall toward the interior surface.

In a $5^{th}$ feature, the present invention provides a dip tube as in the $4^{th}$ feature wherein the annular groove extends circumferentially about the tubular member.

In a $6^{th}$ feature, the present invention provides a dip tube as in any one of the $1^{st}$ to $4^{th}$ features wherein the frangible portion extends circumferentially about the tubular member.

In a $7^{th}$ feature, the present invention provides a dip tube as in any one of the $1^{st}$ to $6^{th}$ features wherein the tubular member extending from the innermost inlet end to the outlet end along a center axis.

In an $8^{th}$ feature, the present invention provides a dip tube as in the $7^{th}$ feature including an axially inwardly directed touchdown foot surface carried at the innermost inlet end, the touchdown foot surface being disposed asymmetrically about the center axis spaced on a radial side from the center axis over a limited circumferential extent of the center axis, the touchdown foot surface located spaced farther axially inwardly than other surfaces of the tubular member, whereby if axial forces are applied axially parallel the center axis that urge the touch down foot surface into a surface, the axial forces are be transferred asymmetrically to the tubular member attempting to deflect the tubular member radially away from the radial side and assisting in creating the threshold tension forces over the frangible portion on a side of the tubular member opposite the radial side.

In a $9^{th}$ feature, the present invention provides a dip tube as in the $7^{th}$ or $8^{th}$ feature, the annular groove disposed in a groove plane intersecting the center axis.

In a $10^{th}$ feature, the present invention provides a dip tube as in the $9^{th}$ feature wherein the groove plane intersects with the center axis forming an acute angle of at least 75 degrees with the center axis.

In an $11^{th}$ feature, the present invention provides a dip tube as in the $7^{th}$, $8^{th}$ or $9^{th}$ feature, the first inlet opening at the innermost inlet end on the inner tube portion lies in a first inlet plane intersecting with the center axis.

In a $12^{th}$ feature, the present invention provides a dip tube as in the $11^{th}$ feature wherein the first inlet plane intersects with the center axis forming an acute angle with the center axis.

In a $13^{th}$ feature, the present invention provides a dip tube as in the $7^{th}$ or $8^{th}$ feature wherein the annular groove disposed in a groove plane intersecting the center axis, the groove plane and the first inlet plane intersect.

In a $14^{th}$ feature, the present invention provides a dip tube as in any one of the $6^{th}$ to $9^{th}$ features wherein the tubular member is rigid against compression or deflection to forces directed parallel to the central axis.

In a $15^{th}$ feature, the present invention provides a dip tube as in any one of the $1^{st}$ to $10^{th}$ features formed as an integral element from plastic material by injection molding.

In a $16^{th}$ feature, the present invention provides a dip tube as in any one of the $1^{st}$ to $11^{th}$ features comprising an integral element of plastic material.

In a $17^{th}$ feature, the present invention provides a dip tube as in any one of the $1^{st}$ to $16^{th}$ features wherein:

while the frangible portion is intact, the tubular member including each of the outer tube portion, the frangible portion while intact, and an inner tube portion, is rigid and resists deflection and compression, and after the frangible portion is broken, (a) the outer tube portion is rigid and resists deflection and compression, (b) the inner tube portion is rigid and resists deflection and compression, and (c) either (1) the inner tube portion is severed from the outer tube portion or (2) the inner tube portion is hingedly connected to the outer tube portion by a hinge-like connection section permitting the inner tube portion to pivot relative the outer tube portion about the connection section.

In an $18^{th}$ feature, the present invention provides a dip tube as in the $1^{st}$ feature wherein the inner tube portion is open at a first inlet opening at the innermost inlet end.

In a $19^{th}$ feature, the present invention provides a dip tube as in the $1^{st}$ feature wherein the inner tube portion is closed at a closed blind end at the innermost inlet end.

In a $20^{th}$ feature, the present invention provides a dip tube as in any one of the $1^{st}$ to $18^{th}$ features further comprising an axially innermost plug member and an intermediate annular frangible bridge member bridging between the tubular member and the plug member, the plug member extending from an axially innermost plug touchdown end to an axially outer plug outer end, the plug member having an exterior surface extending between the plug touchdown end and the plug outer end, with the frangible bridge member intact, the frangible bridge member coupling the tubular member and the plug member with the plug touchdown end of the plug member disposed axially inwardly of the innermost inlet end, the frangible bridge member spanning between the tubular member and the exterior surface of the plug member with the frangible bridge member and the plug member sealably closing the inlet opening, the frangible bridge member selected such that while the frangible bridge member is intact, on the application of a threshold compression force to the plug touchdown end of the plug member urging the plug axially outwardly relative the tubular member and across the frangible bridge member, the frangible bridge member breaks and the plug member is displaced axially outwardly via the inlet opening into the passageway opening the inlet opening for passage of fluid axially inwardly therethrough, the threshold compression force selected to provide for breaking of the frangible bridge member without applying sufficient forces to create the threshold tension force.

In a $21^{st}$ feature, the present invention provides a dip tube comprising an elongate hollow tubular member, an axially innermost plug member and an intermediate annular frangible bridge member bridging between the tubular member and the plug member, the tubular member extending from an innermost inlet end to an outlet end, the tubular member having an outlet opening at the outlet end and an inlet opening at the innermost inlet end, the tubular member defining a sealed continuous interior passageway through the tubular member between the outlet opening at the outlet end and the inlet opening at the innermost inlet end, the plug member extending from an axially innermost plug touchdown end to an axially outer plug outer end, the plug member having an exterior surface extending between the plug touchdown end and the plug outer end, with the frangible bridge member intact, the frangible bridge member coupling the tubular member and the plug member with the plug touchdown end of the plug member disposed axially inwardly of the innermost inlet end on the tubular member, the frangible bridge member spanning between an interior surface of the tubular member and the exterior surface of the plug member with the frangible bridge member and the plug member sealably closing the inlet opening, the frangible bridge member selected such that while the frangible bridge member is intact, on the application of a threshold compression force to the plug touchdown end of the plug member urging the plug axially outwardly relative the tubular member and across the frangible bridge member, the frangible bridge member breaks and the plug member is displaced axially outwardly via the inlet opening into the passageway opening the inlet opening for passage of fluid axially inwardly therethrough.

In a $22^{nd}$ feature, the present invention provides a dip tube as in the $21^{st}$ feature wherein the frangible bridge member is disposed between the plug member and the tubular member annularly radially outwardly about the plug member and annularly radially inwardly of the tubular member.

In a $23^{rd}$ feature, the present invention provides a dip tube as in the $21^{st}$ or $22^{nd}$ feature wherein the cross-sectional area of the passageway axially outwardly of the inlet opening is greater than the cross-sectional area of the plug to assist in the plug member in being displaced axially outwardly into the passageway from the inlet opening and passage of fluid axially inwardly through the passageway and past the plug member when received in the passageway.

In a $24^{th}$ feature, the present invention provides a dip tube as in the $21^{st}$ or $22^{nd}$ feature wherein the interior surface of the portion tubular member increases in diameter axially outwardly from the frangible bridge member to assist in the plug member in being displaced axially outwardly into the passageway and passage of fluid axially inwardly through the passageway past the plug member received in the passageway.

In a $25^{th}$ feature, the present invention provides a dip tube as in any one of the $1^{st}$ to $24^{th}$ features in combination with a fluid pump that draws a fluid into a pump intake conduit for discharge, wherein the outlet end of the dip tube is coupled in a fluid sealed relation to the pump intake conduit with the dip tube during operation of the pump extending downwardly from the outlet end of the dip tube pump toward the intermediate inlet end on the outer tube portion.

In a $26^{th}$ feature, the present invention provides a dip tube as in any one of the $1^{st}$ to $24^{th}$ features in combination with a fluid pump and a reservoir, the reservoir having an interior cavity bounded by side walls and a bottom wall and open upwardly from the side walls at an open reservoir upper opening, the side walls closed at a lower end by the bottom wall, the side walls having an interior side wall surface, the bottom wall having an upwardly directed interior bottom surface, the fluid pump having a pump intake conduit to draw fluid into the pump for discharge from a pump discharge outlet, a pump assembly comprising the dip tube coupled to the pump with the outlet end of the dip tube fixedly secured to the to the pump intake conduit in a fluid sealed relation, a locating mechanism to locate the pump assembly in a desired pumping position relative the reservoir for operation of the pump, in the desired pumping position with the frangible portion between the dip tube extends into the reservoir cavity through the reservoir upper opening downwardly from the outlet end of the dip tube towards the upwardly directed interior bottom surface of the bottom wall a desired extent for placement of the intermediate inlet opening proximate the bottom surface for operation of the pump to draw fluid from the reservoir via the dip tube, an inoperative position in the pump assembly is located relative the reservoir above the desired pumping position with the dip tube extending downwardly into the reservoir through the reservoir upper opening from the outlet end of the dip tube to locate the inlet end of the dip tube within the reservoir above and engaged with the upwardly directed interior bottom surface of the bottom wall, relative movement of the reservoir of the pump assembly from the inoperative position to the desired pumping position results in the inlet end of the dip tube and the upwardly directed interior bottom surface of the bottom wall engage producing the tension force between the inner tube portion and the outer tube portion across the frangible portion sufficient to break the frangible portion, in the desired pumping position with the frangible portion broken, the pump assembly is operative to draw fluid from the reservoir directly into the second inlet opening at the intermediate inlet end on the outer tube portion and merely through the continuous shorter interior passageway.

In a $27^{th}$ feature, the present invention provides a combination as in the $26^{th}$ feature wherein the reservoir proximate the upwardly directed interior bottom surface having a diametric width between opposing side wall interior surfaces at least equal to a sum of a. (a diameter of the outer tube portion at the intermediate inlet end) and b. (a maximum length of the inner tube portion from the intermediate outlet end to the innermost inlet end).

In a $28^{th}$ feature, the present invention provides a combination as in the $26^{th}$ feature wherein the reservoir bottom surface having a center point having a minimum distance from the interior side wall surface of each side wall at least equal to the sum of a. (½ a diameter of the outer tube portion at the intermediate inlet end) and b. (a maximum length of the inner tube portion from the intermediate outlet end to the innermost inlet end).

In a $29^{th}$ feature, the present invention provides a combination as in the $26^{th}$ feature wherein:

on application of the tension force between the inner tube portion and the outer tube portion across the frangible portion sufficient to break the frangible portion, the frangible portion breaks about a substantial section of the circumference of the frangible portion but remains unbroken about an unsevered section forming a hinged connection between the inner tube portion and the outer tube portion about which the inner tube portion pivots to move the inlet end laterally of and upwardly relative to the outer tube portion.

In a $30^{th}$ feature, the present invention provides a dip tube as in any one of the $20^{th}$ to $24^{th}$ features in combination with a fluid pump and a reservoir, the reservoir having an interior cavity bounded by side walls and a bottom wall and open upwardly from the side walls at an open reservoir upper opening, the side walls closed at a lower end by the bottom wall, the side walls having an interior side wall surface, the bottom wall having an upwardly directed interior bottom surface, the fluid pump having a pump intake conduit to draw fluid into the pump for discharge from a pump discharge outlet, a pump assembly comprising the dip tube coupled to the pump with the outlet end of the dip tube fixedly secured to the to the pump intake conduit in a fluid sealed relation, a locating mechanism to locate the pump assembly in a desired pumping position relative the reservoir for operation of the pump, in the desired pumping position the dip tube extends into the reservoir cavity through the reservoir upper opening downwardly from the outlet end of the dip tube towards the upwardly directed interior bottom surface of the bottom wall a desired extent for operation of the pump to draw fluid from the reservoir via the dip tube, an inoperative position in the pump assembly is located relative the reservoir above the desired pumping position with the dip tube extending downwardly into the reservoir through the reservoir upper opening from the outlet end of the dip tube to locate the plug touchdown end of the dip tube within the reservoir above the upwardly directed interior bottom surface of the bottom wall, with downward movement relative the reservoir of the pump assembly from the inoperative position to the desired pumping position, the plug touchdown end of the dip tube and the upwardly directed interior bottom surface of the bottom wall engage producing the compression force across the frangible bridge member sufficient to break the frangible bridge member, in the desired pumping position with the frangible bridge member broken, the pump is operative to draw fluid from the reservoir into the inlet opening.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 1:
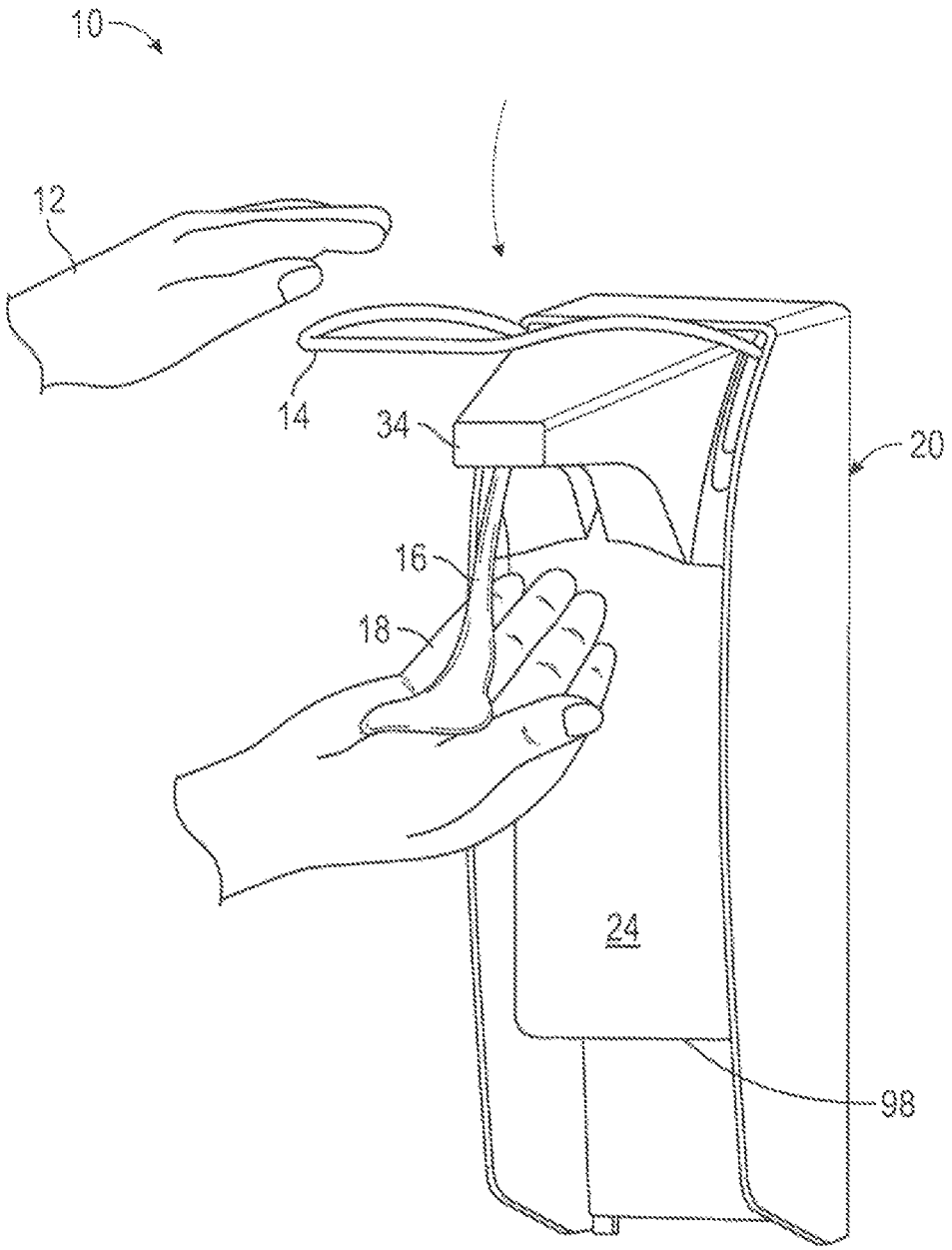
FIG. 1 is a perspective view of a fluid dispenser in accordance with a first embodiment of the invention schematically shown as being manually used by a user to dispense hand soap.

Reference is made first to FIG. 1 which illustrates a first embodiment of a fluid dispenser 10 adapted to be secured to a wall (not shown), and configured for manual activation as by a user using one hand 12 to urge a lever 14 downwardly so as to dispense fluid 16 onto the user's other hand 18. The fluid dispenser 10 is similar to that disclosed in each of U.S. Pat. No. 7,748,573 to Ophardt et al., issued Jul. 6, 2010 and EP 3081312 published 19 Oct. 2016, the disclosures of which are incorporated herein by reference.

Figure 2:
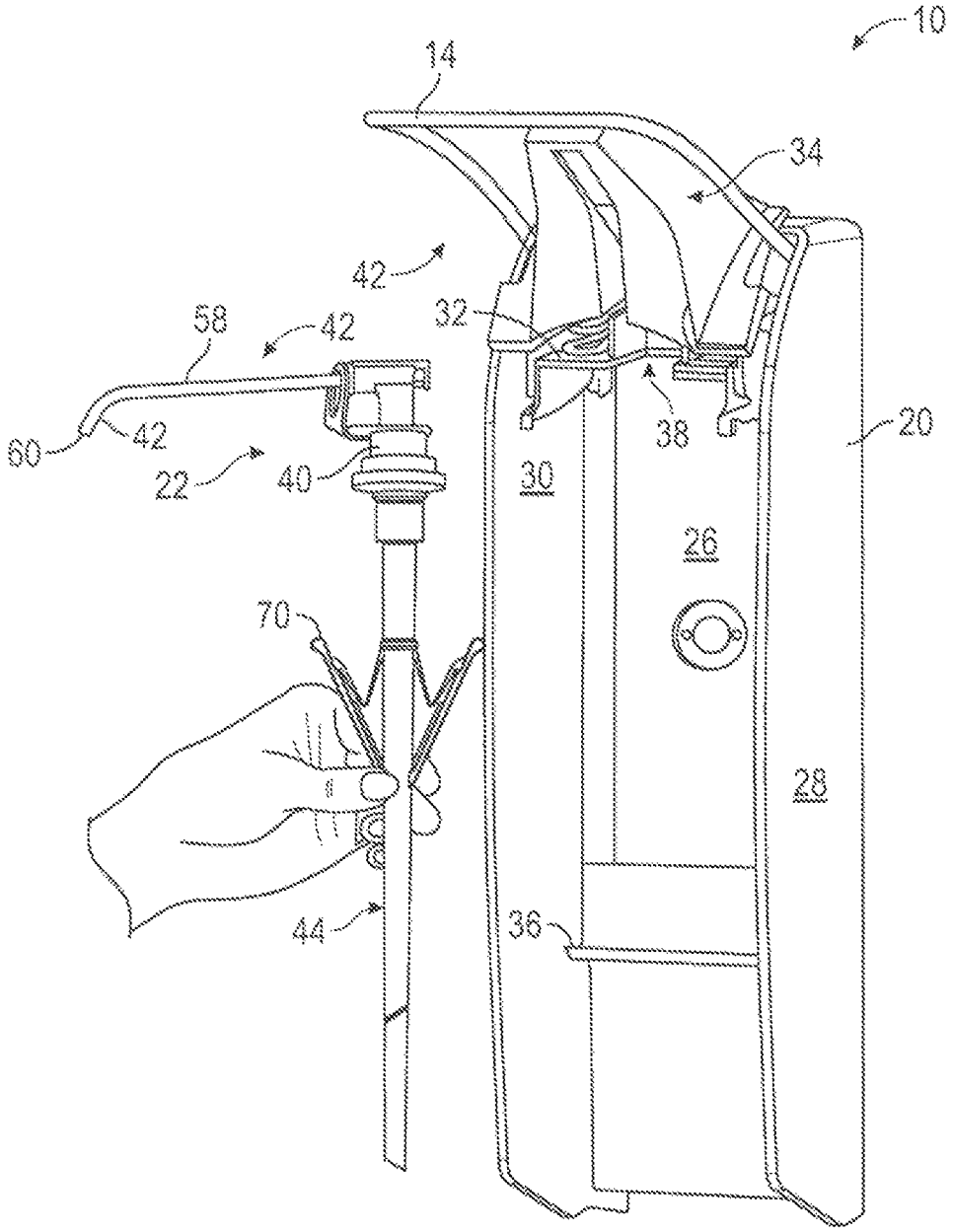
FIG. 2 is a perspective view of the fluid dispenser of FIG. 1, with a fluid reservoir removed and a pump assembly including a pump and a dip tube being manually held by a user for insertion or removal.

The fluid dispenser 10 includes a housing 20, a pump assembly 22, and a fluid reservoir 24. The housing 20 is best shown in FIG. 2 as having a back plate 26, spaced side walls 28 and 30, and an upper plate 32 defining an interior space therebetween sized for receiving the fluid reservoir 24 therein. A nozzle shield 34 is movably coupled to the upper plate 32 to permit movement between a raised open position as shown in FIG. 2, wherein the pump assembly 22 can be inserted or removed from the housing 20, and a closed position as shown in FIG. 1. The upper plate 32 defines a central slot 38 adapted for removably coupling with a collar region 40 of the pump assembly 22. A support member 36 is attached to the back wall 26 for engaging a bottom wall 98 of the fluid reservoir towards assisting in supporting the fluid reservoir 24 on the housing 20.

The pump assembly 22 is best shown in FIG. 2 as including a pump 42 and a dip tube 44. The pump assembly 22 is adapted to be removably coupled to the upper plate 32 for dispensing fluid from the fluid reservoir 24. The fluid pump 42 has a fluid intake conduit to draw fluid into the pump 42 for discharge from a pump discharge outlet.

Figure 3:
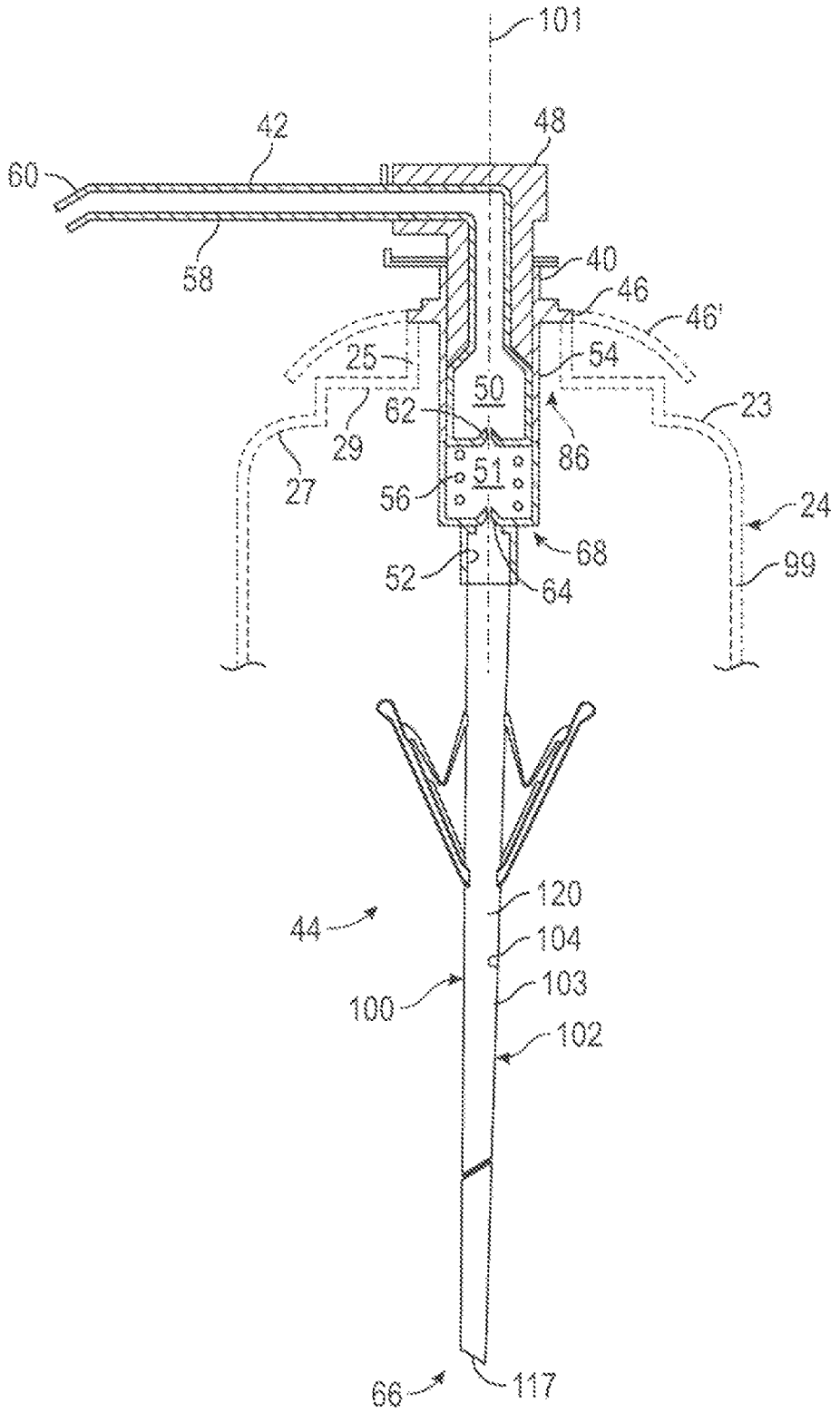
FIG. 3 is a cross-sectional side view of the pump assembly in FIG. 2.
Figure 4:
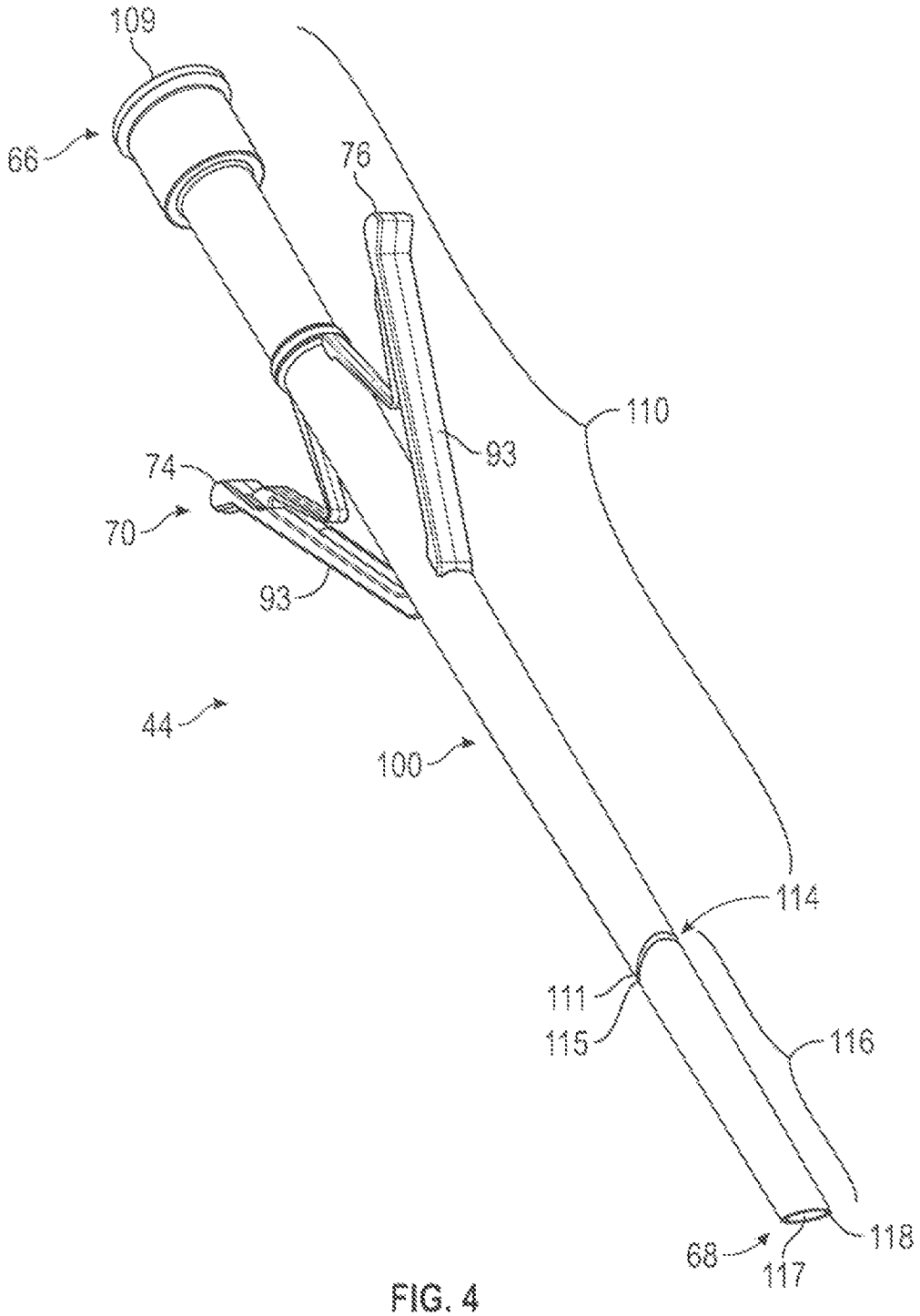
FIG. 4 is a perspective view of the dip tube in FIG. 2.
Figure 5:
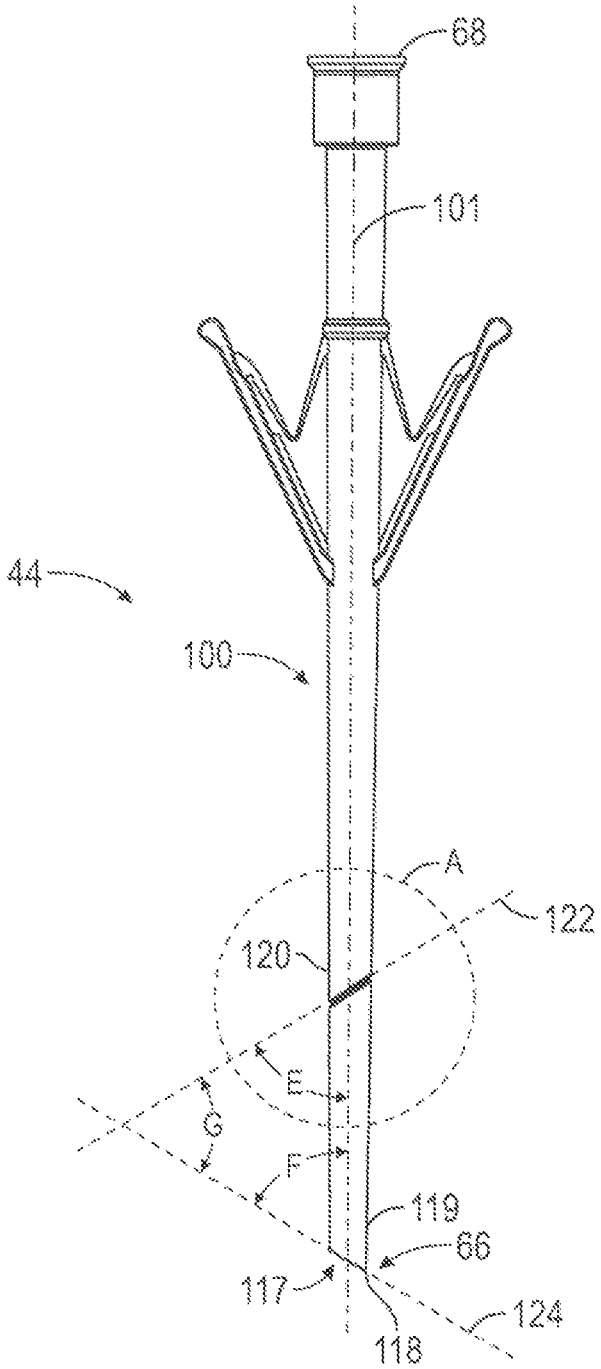
FIG. 5 is a side view of the dip tube of FIG. 4.

As seen in FIGS. 3 to 5, the dip tube 44 is formed as an elongated hollow tube or tubular member 100 that extends downwardly along a longitudinal center axis 101 from an outlet end 68 to an innermost inlet end 66. The outlet end 68 of the dip tube 44 is coupled to the pump intake conduit of the pump 42. The innermost inlet end 66 of the tubular member 100 is to be positioned in the fluid reservoir 24. With operation of the pump 42, when the innermost inlet end 66 is below a level of liquid in the reservoir 24, the pump 42 draws fluid 16 from the fluid reservoir 24 via the dip tube 44.

Figure 6:
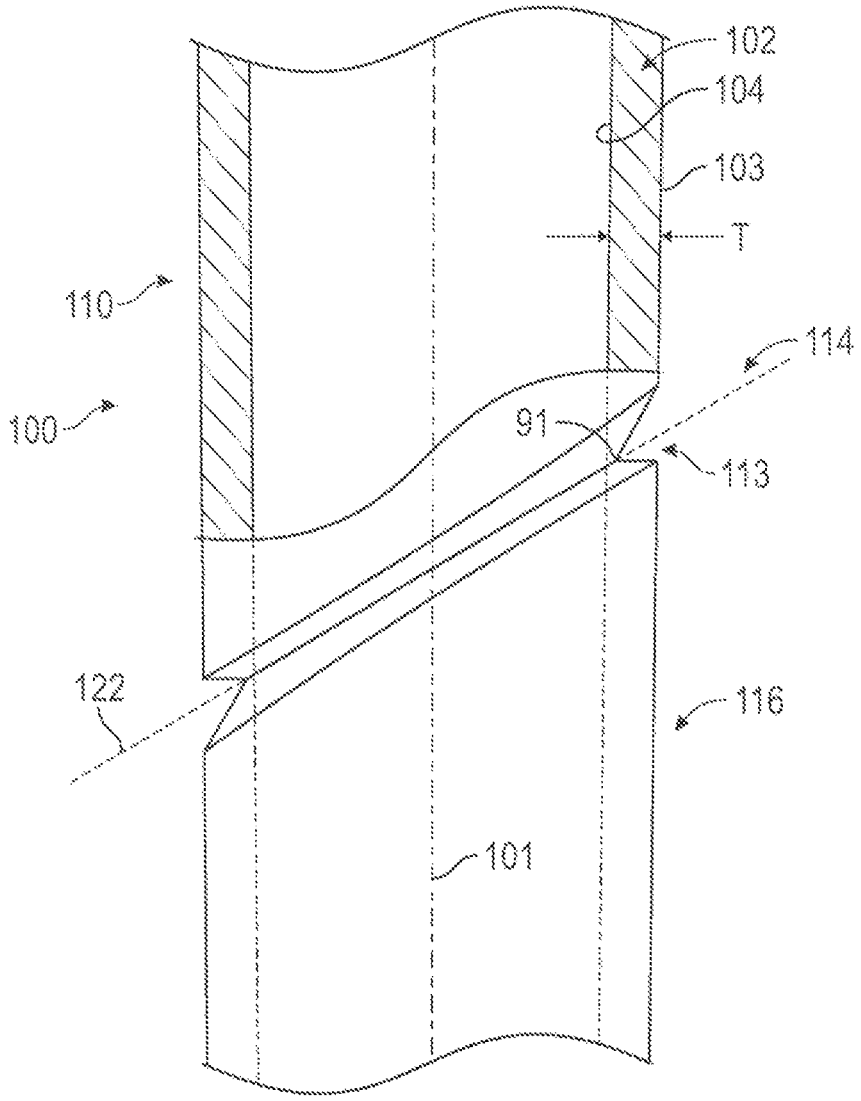
FIG. 6 is an enlarged view of the dip tube in FIG. 5 within the broken line circle A in FIG. 5 but with an uppermost portion in cross-section.
Figure 7:
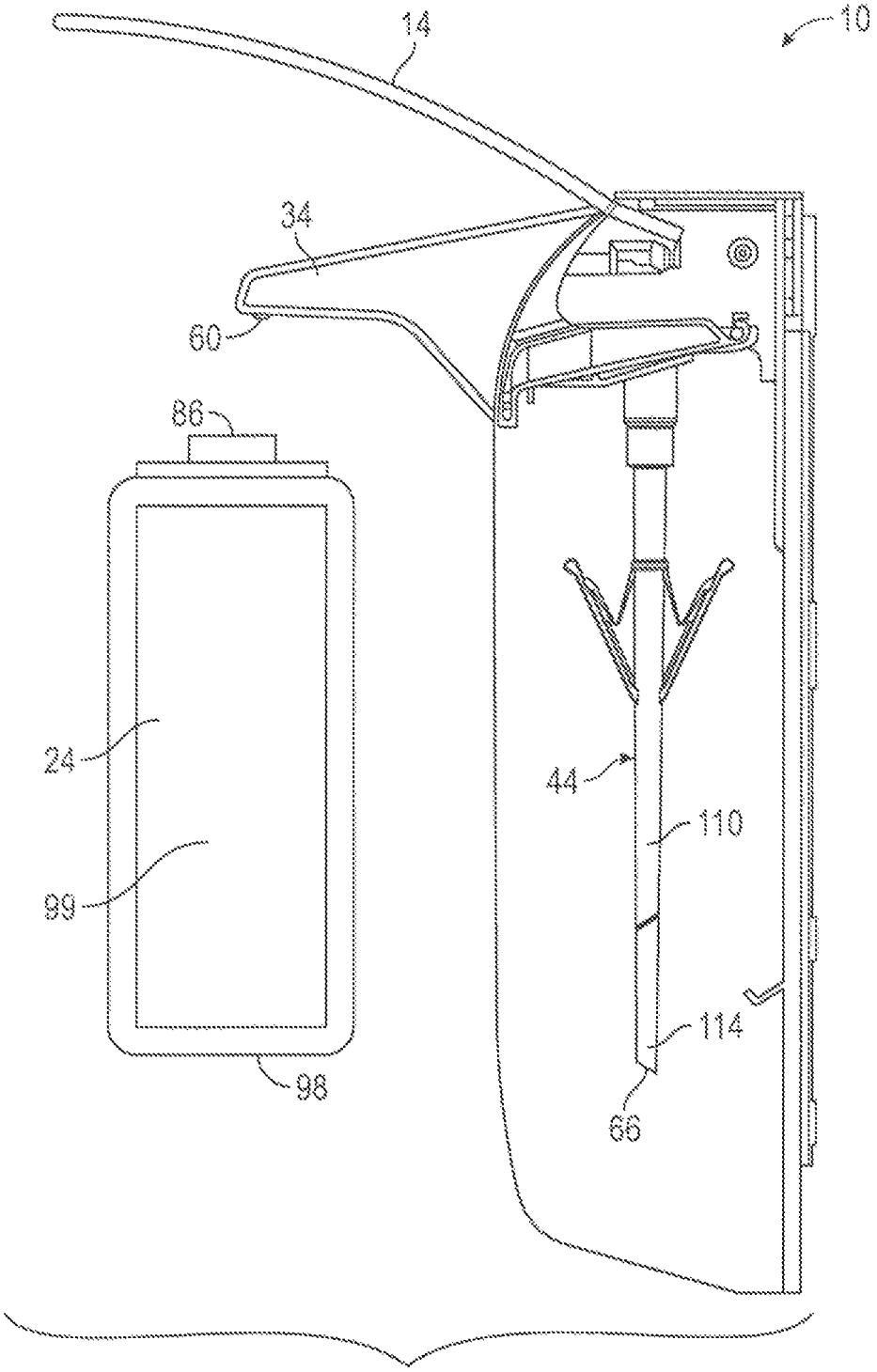
FIG. 7 is a schematic, partially cut-away cross-sectional side view of the dispenser of FIG. 1, with the pump assembly coupled to the housing and a first fluid reservoir separate from the pump assembly and housing.

The dip tube 44 is best seen in FIGS. 4 to 6. The hollow tubular member 100 has a cylindrical side wall 102 as best seen in FIG. 6 in partial cross-section. The tube wall 102 has an exterior surface 103 and an interior surface 104 with a thickness T between the interior surface 104 and the exterior surface 103 as measured radially relative to the central axis 100.

As best seen in FIG. 4, the tubular member 100 has an outer tube portion 110, an intermediate frangible tube portion 114 and an inner tube portion 116. The outer tube portion 110 includes the outlet end 68 and extends inwardly from the outlet end 68 to an intermediate inlet end 111 on the outer tube portion 110. The inner tube portion 116 includes the innermost inlet end 66 and extends outwardly from the innermost inlet end 66 to an intermediate outer end 115 on the inner tube portion 116.

Figure 10:
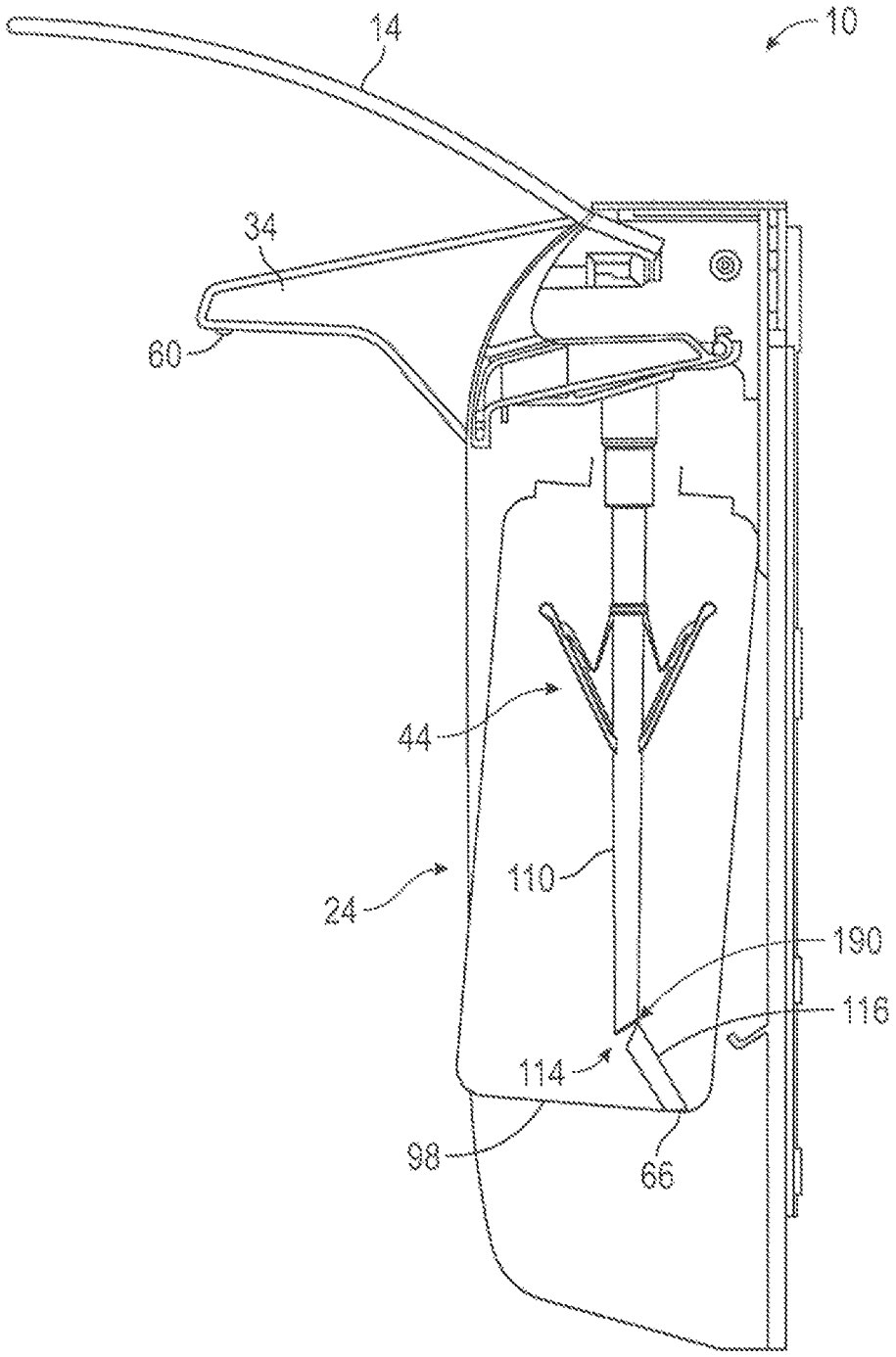
FIG. 10 is a schematic, partially cut-away cross-sectional side view similar to FIG. 8 but with the first fluid reservoir in a third intermediate position in the process of being coupled to the pump assembly and housing.
Figure 11:
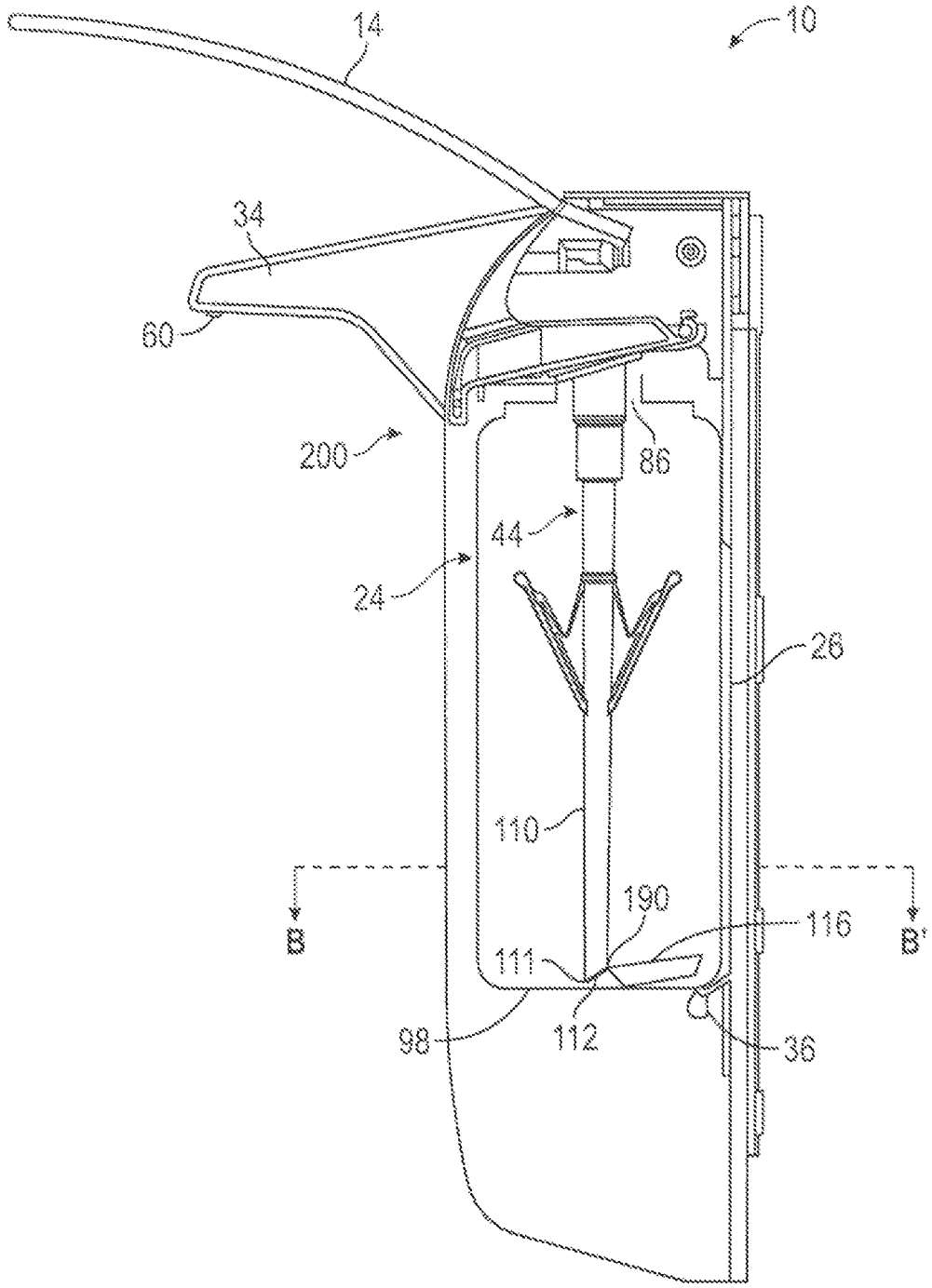
FIG. 11 is a schematic, partially cut-away cross-sectional side view similar to FIG. 8 but with the first fluid reservoir fully coupled to the pump assembly and supported on the housing in a condition for operation of the pump to dispense fluid.

The frangible tube portion 114 bridges between the outer tube portion 110 and the inner tube portion 116 providing communication between the intermediate inlet end 111 on the outer tube portion 110 and the intermediate outer end 115 on the inner tube portion 116. The frangible tube portion 114 extends circumferentially about the tubular member 100. The frangible tube portion 114 is selected such that while the frangible tube portion 114 is intact, on the application of a threshold tension force between the inner tube portion 116 and the outer tube portion 110 across the frangible tube portion 114, the frangible tube portion 114 breaks. The frangible tube portion 114 fractures and breaks without damaging the integrity of the inner tube portion 116 or the outer tube portion 110. The frangible tube portion 114 when broken is shown in FIGS. 10 and 11.

With the frangible tube portion 114 intact as seen, for example, in FIGS. 1 to 9 and 12, the interior surface 104 of the tube wall 102 defines a sealed continuous long interior passageway 120 through each of the outer tube portion 110, the frangible tube portion 114 and the inner tube portion 116 of the tubular member 100 between an outlet opening 109 at the outlet end 68 on the outer tube portion 100 and the innermost inlet end 66 on the inner tube portion 116.

The fluid reservoir 24 is preferably a hollow thin walled container formed with a circumferential side wall 99 that is closed at a lower end by the bottom wall 98. The bottom wall 98 provides an axially inwardly, that is, upwardly directed interior bottom surface 97. The side wall 99 merges at an upper end into an upper reservoir opening 86.

The reservoir 24 has an interior cavity 25 bounded by the side wall 99, the bottom wall 98 and open upwardly from the side wall 99 at the open upper reservoir opening 86. The side wall 99 is closed at its lower end by the bottom wall 98. The side wall 99 has an interior side surface 128.

Figure 8:
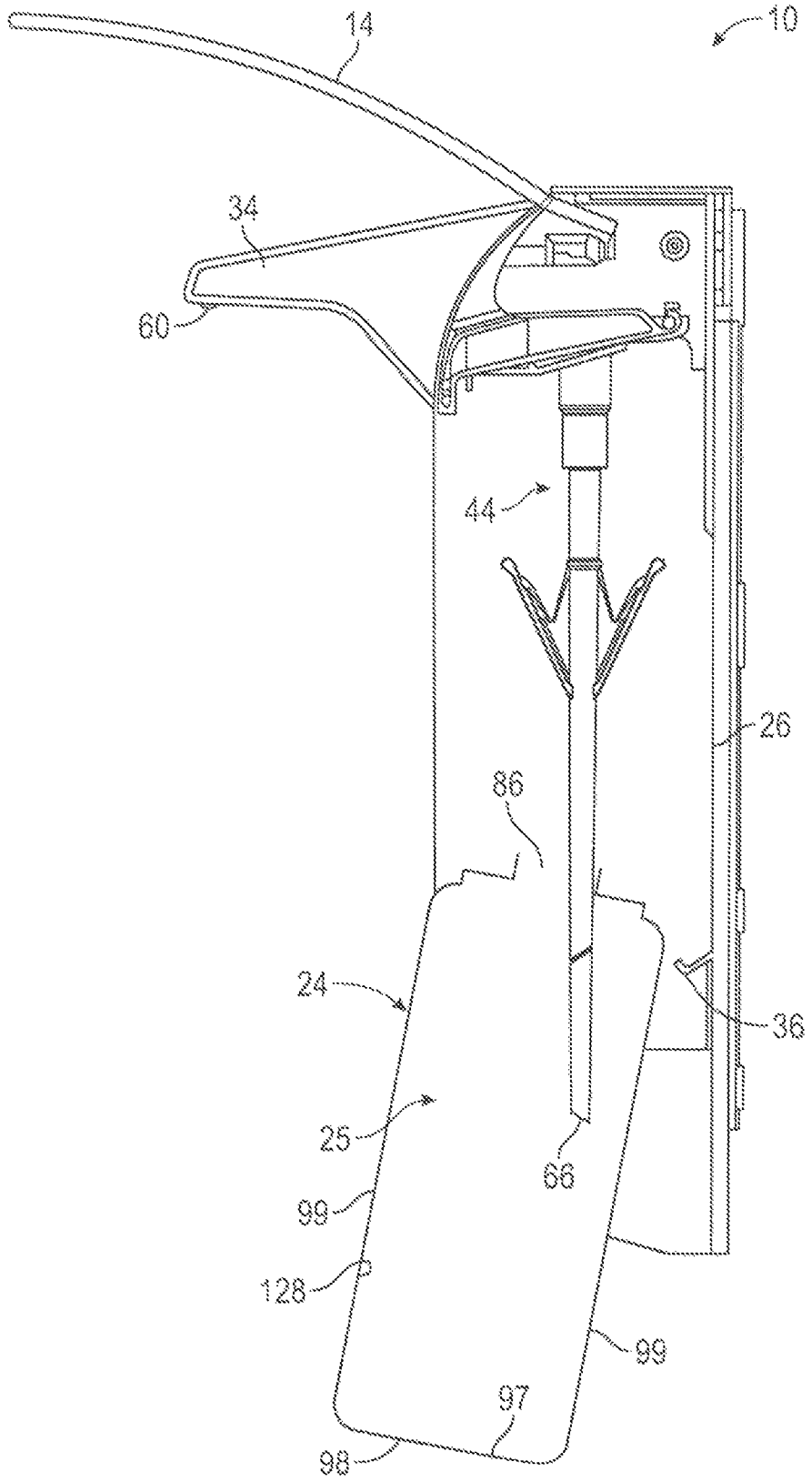
FIG. 8 is a schematic, partially cut-away cross-sectional side view similar to FIG. 7 but with the first fluid reservoir in a first intermediate position in the process of being coupled to the pump assembly and housing.

The first embodiment of FIGS. 1 to 11 illustrates one preferred use of the dip tube 44 with the dispenser 10 in a manner that the pump assembly 22 carrying the dip tube 44 is first coupled to the housing 20, as seen in FIG. 8 and, subsequently, a reservoir 24 in a short form as shown in FIGS. 1 to 11 is subsequently coupled to the pump assembly 22 and the housing 20 as shown in sequence by FIG. 8, FIG. 9, FIG. 10, and FIG. 11.

Figure 9:
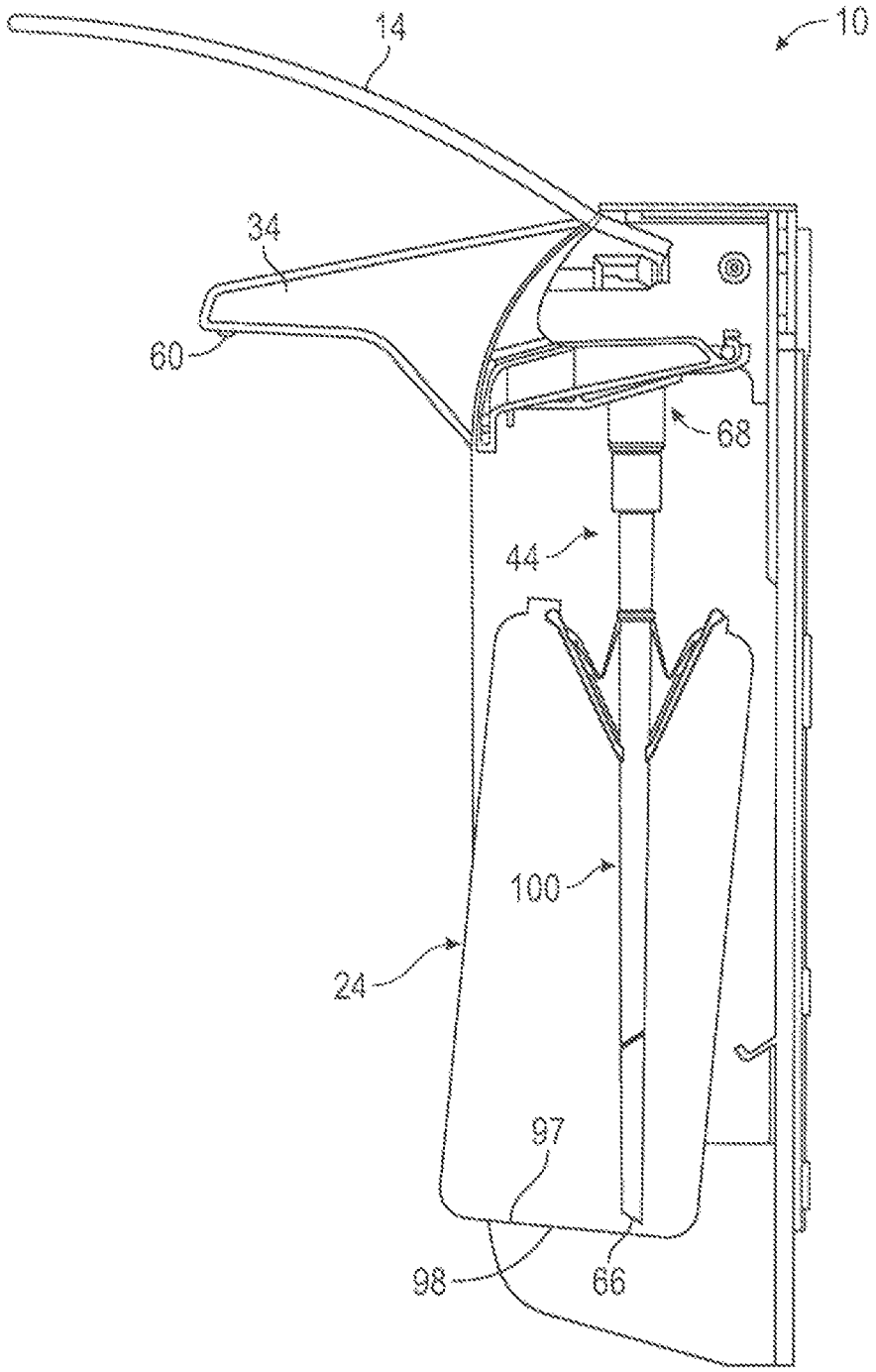
FIG. 9 is a schematic, partially cut-away cross-sectional side view similar to FIG. 8 but with the first fluid reservoir in a second intermediate position in the process of being coupled to the pump assembly and housing.

In FIG. 8, the reservoir 24 is manipulated to be placed disposed at an angle and moved upwardly such that a rear portion of the reservoir side wall 99 passes in between the innermost inlet 66 of the dip tube 44 and the support member 36 on the back wall 26 of the housing 20. From the position of FIG. 8, the reservoir 24 is moved upwardly with the dip tube 44 inside the reservoir 24 until, as seen in FIG. 9, the innermost inlet end 66 of the dip tube 44 comes into engagement with the upwardly directed bottom surface 97 of the bottom wall 98 of the reservoir 24. From the position of FIG. 9, the reservoir 24 is manually moved upwardly. Engagement between the bottom wall 98 of the reservoir 24 and the innermost inlet end 66 of the dip tube 44 applies axial compressive forces to the tubular member 100 compressing the tubular member 100 between the innermost inlet end 66 and the outlet end 68 which is fixedly secured to the housing 20. The hollow tubular member 100 is sufficiently rigid that it rigidity that resists deflection axially or radially relative the center axis by the axial the compressive forces, however, the axial compressive forces in attempting to reduce the axial length of the tubular member 100 between the innermost inlet end 66 and the outlet end 68 attempt to deflect the tubular member 100 to bow or curve laterally, that is, radially forwardly from the center axis 101 developing and applying an axial tension force on one lateral side of the tubular member 100. This tension force is effectively applied along the entire length of the tubular member 100 between the innermost inlet end 66 and the outlet end 68 and thus is applied across the frangible portion 114 between the inner tube portion 116 and the outer tube portion 110. When the tension force reaches a threshold tension force on one lateral side of the frangible portion 114, the threshold tension force is sufficient that the frangible portion 114 ruptures and breaks. Such breaking initiates on the one lateral side of the frangible portion 114 and spreads from that one lateral side circumferentially towards the opposite lateral side and circumferentially about the frangible portion 114, and can completely sever the frangible portion 114, separating the inner tube portion 116 from the outer tube portion 110 as is an advantageous result in accordance with the present invention. However in FIGS. 10 and 11 the frangible portion 114 is not shown to be completely severed but rather to maintain some limited connection between the inner tube portion 116 and the outer tube portion 110. As shown, with continued manual movement of the reservoir 24 upwardly from the position of FIG. 9 to the position of FIG. 10, the frangible portion 114 has been severed on a radially forward lateral side of the frangible portion 114 relative to the central axis 101 with the frangible portion 114 severing from the radially forward lateral side rearwardly to a radially rearward lateral side where, as seen in FIG. 10, the frangible portion 114 is seen in FIG. 10 at the radially rearward lateral side of the tubular member 100 as continuing to provide a flexible hinge-like connection section 190 between the outer tube portion 110 and the inner tube portion 116 that remains unbroken. From the position of FIG. 10, the reservoir 24 is manually moved upwardly relative the housing 20 until the bottom wall 98 moves upwardly above the support member 36 and the reservoir 24 can then be moved rearwardly into engagement with the back wall 26 of the housing with the bottom wall 98 of the reservoir 24 to sit upon the support member 36. In the position of FIG. 11, the reservoir is supported on the housing 20 against removal by reason of the bottom wall 98 sitting on the support member 36 and the dip tube 44 extending through the reservoir opening 86. In movement of the reservoir 24 upwardly from the position of FIG. 10 to the position of FIG. 11, the inner tube portion 116 is shown to have pivoted about the flexible hinge-like connection section 190 of the frangible portion 114 so as to extend rearwardly and substantially horizontally from the intermediate inlet end 111 on the outer tube portion 110. In the position of FIG. 11, the intermediate inlet opening 112 at the intermediate inlet end 111 on the outer tube portion 110 is located proximate to the bottom wall 98 in an advantageous position that with operation of the pump, substantially all of the fluid in the reservoir may be drawn by the pump through the intermediate inlet opening 112 at the intermediate inlet end 111 of the outer tube portion 110.

With the frangible tube portion 114 broken as illustrated in FIGS. 10 and 11, the interior surface 104 of the tube wall 102 over the outer tube portion 110 defines a sealed continuous short interior passageway through the outer tube portion 110 between the outlet opening 109 at the outlet end 68 on the outer tube portion 110 and an intermediate inlet opening 112 at the intermediate inlet end 111 on the outer tube portion 110. The intermediate inlet opening 112, as best seen in FIG. 11, is open through the tube wall 102 of the outer tubular portion 110, as to the exterior surface 103 of the tube wall 102 at the intermediate inlet end 111.

With engagement between the bottom wall 98 of the reservoir 24 and the dip tube 44, the frangible portion 114 has been described as breaking over a large proportion of the circumference of the frangible portion 114 with the inner tube portion 116 to be hingedly connected to the outer tube portion 110 by the remaining unbroken connection section 190 of the frangible portion 114 over a small portion of the circumference of the frangible portion 114 which unbroken connection section 190 permits the inner tube portion 116 to pivot relative the outer tube portion 110 about this unbroken connection section 190 of the frangible portion 116. However, there is no necessity for the frangible portion 114 to be configured to not break about its entire circumference. On the engagement between the bottom wall 98 of the reservoir 24 and the innermost inlet end 66 of the dip tube 44, the frangible portion 114 may break circumferentially about its entire circumference with the inner tube portion 116 to become severed from the outer tube portion 110. Insofar, however, as the frangible portion 114 is broken, to provide the inner tube portion 116 to be hingedly connected to the other tube portion 110 by the remaining unbroken connection section 190 of the frangible portion 114, then the side wall 99 of the reservoir 24 preferably provides adequate room for the inner tube portion 116 to extend radially away from the outer tube portion 110 as shown in FIG. 11.

Figure 13:
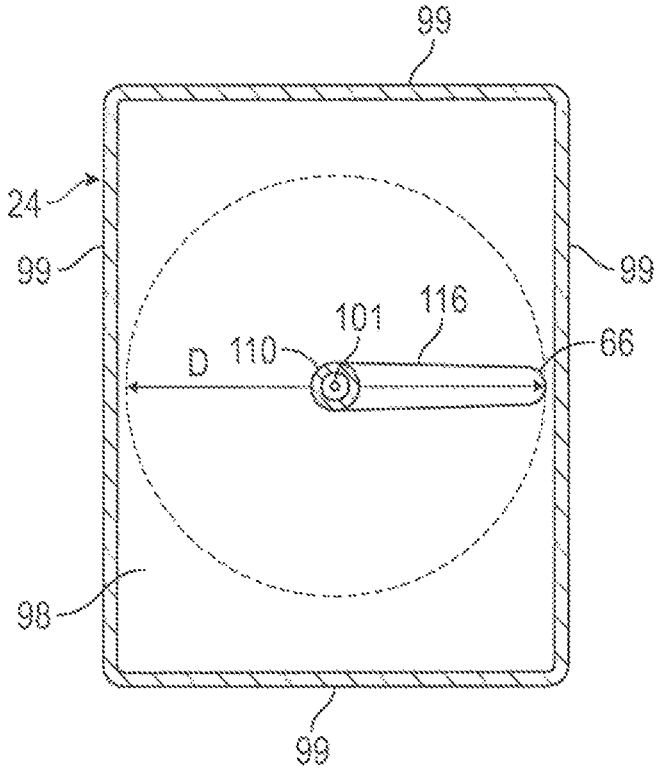
FIG. 13 is a cross-sectional top view of the reservoir and dip tube along section line B-B' on FIG. 11.

In this regard, FIG. 13 shows a cross-sectional top view along section B-B' in FIG. 11 showing the central axis 101, coaxially within the outer tube 110 and with the inner tube portion 116 rearwardly from the outer tube 110 towards a rear of the side wall 99. Preferably, in accordance with the present invention, each face of the side wall 99 is spaced from an approximate center point of the bottom wall 98 a minimum distance D at least equal to the sum of a. (½ a diameter of the outer tube portion 110 at the intermediate inlet end 111) and b. (a maximum length of the inner tube portion 116 from the intermediate outlet end 115 to the innermost inlet end 66).

Figure 12:
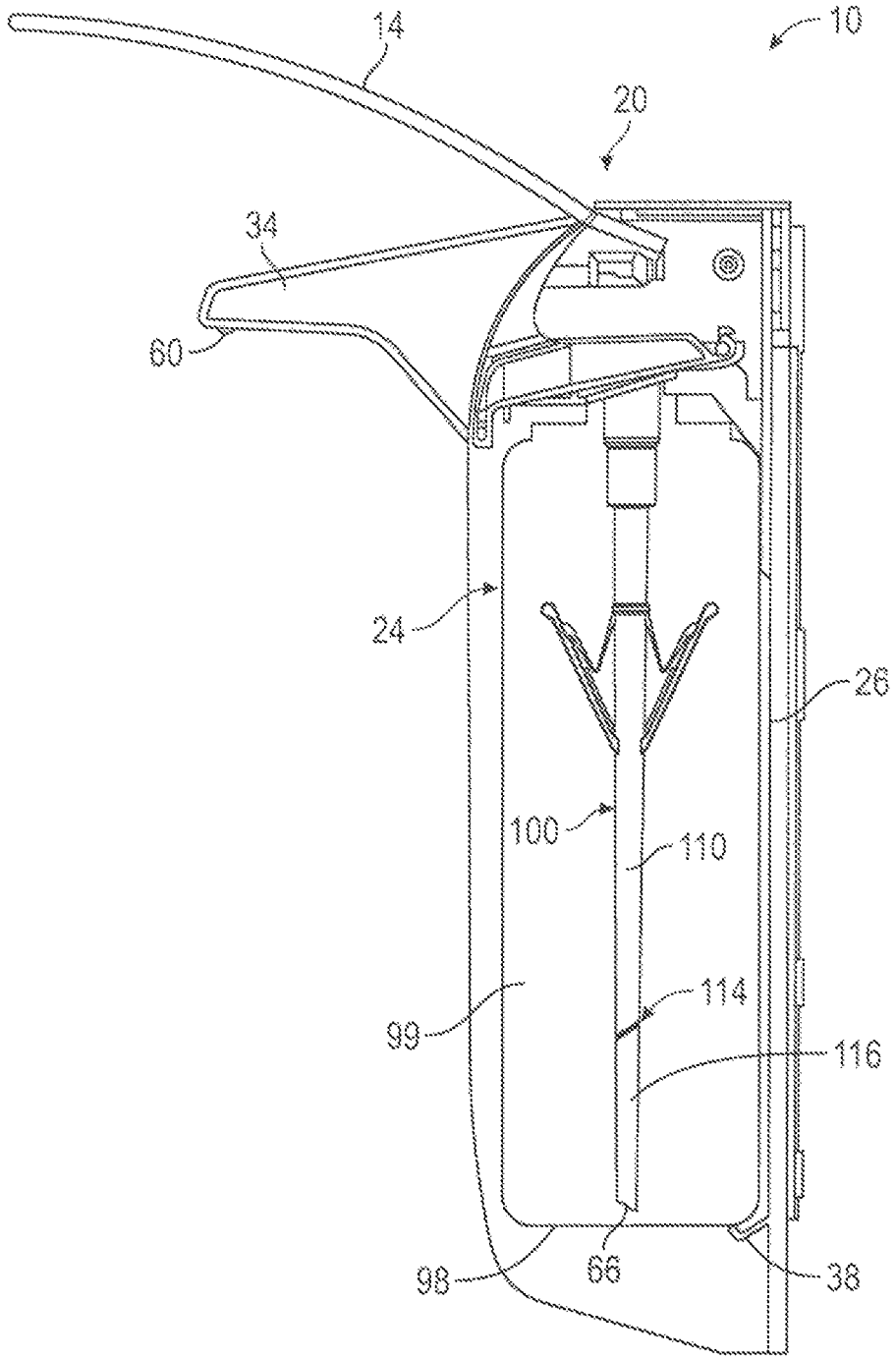
FIG. 12 is a schematic, partially cut-away cross-sectional side view similar to FIG. 11 but with a second fluid reservoir fully coupled to the pump assembly and supported on the housing in a condition operation of the pump to dispense fluid.

Reference is made to FIG. 12 which illustrates a pump assembly 22 coupled to the housing 20 in a configuration identical to that shown in FIG. 11 but for a first exception that the support plate member 36 is, in FIG. 12, located at a lower height on the back wall 26 than in FIGS. 7 to 11. In FIG. 12, the reservoir 24 is a long form of the reservoir that identical to the short form of the reservoir shown in FIGS. 7 to 11 other than that the reservoir 24 in FIG. 12 has a longer length by reason of the side wall 99 having a longer axial extent. The long form of the reservoir 24 is shown in FIG. 12 in an operative condition ready for operation of the pump to discharge fluid from the reservoir 24 with the bottom wall 98 of the reservoir 24 supported on the support member 36 and the dip tube 44 extending downwardly with its inlet end 66 disposed closely proximate to but above the bottom wall 98 as is advantageous with operation of the pump to draw substantially all of the fluid from the long form of the reservoir 24. The long form of the reservoir 24 can be coupled to the housing 20 in an analogous manner that the short form of the reservoir 24 is coupled to the reservoir as illustrated in FIGS. 8 to 11, however, with the long form of the reservoir 24 moving upwardly relative the housing 20 and the dip tube 44 to assume the position of FIG. 12 without the bottom wall 98 of the reservoir 24 coming into engagement with the inlet end 66 of the dip tube 44 or, at the least, without engagement which would create sufficient forces to break the frangible portion 114.

Referring to FIG. 6, the thickness T of the tube wall 102 over the frangible portion 114 is shown as being less than a thickness of the tube wall 102 over any section of the outer tubular portion 110 and the inner tube portion 116. As seen in FIG. 6, the thickness of the tube wall 102 between the exterior surface 103 and the interior surface 104 over the outer tube portion 110 and over the inner tube portion 116 is substantially constant. The thickness of the tube wall 102 over the frangible portion 114 is preferably selected such that while the frangible portion 114 is intact as shown in FIG. 6, once there is the application of the threshold tension force between the interior tube portion 116 and the outer tube portion 110 across the frangible portion 114, the frangible portion 114 selectively breaks without damaging the outer tube 110 and preferably without also damaging the inner tube portion 116. As seen in FIG. 6, the frangible portion 114 includes an annular groove 113 that extends circumferentially about the tube wall 102. The groove 113 extends radially inwardly into the tube wall 102 from the exterior surface 103 of the tube wall 102 towards the interior surface 104. At an apex 91 of this annular groove 113, the thickness of the tube wall 102 is at a minimum which is substantially less than the thickness of the tube wall 102 at any other locations and thus provide the frangible portion 114 as an annular weakened circumferential ring of the tube wall 102 which when the tension force is applied, will selectively break and rupture the frangible portion 114. In the preferred embodiment as shown in FIG. 6, the frangible portion 114 extends circumferentially about the tubular member 100 by the annular groove 113 extending entirely circumferentially about the tubular member 100. In the preferred embodiment, the annular groove 113 is disposed in a flat planar groove plane 122 intersecting with the center axis 101. In the preferred embodiment, the groove plane 122 is shown on FIG. 5 as intersecting with the center axis 101 forming an acute angle E of about 45° with the center axis 101. The groove plane 122 may intersect with the center axis 101 forming the acute angle E in the range of 45 to 90 degrees, more preferably 45° to 75° with the center axis 101. It is not necessary that the frangible member 114 be disposed in a flat planar plane and the frangible member 114 need merely extend over a substantial circumferential extent about the tubular member 100.

As can be seen in FIGS. 3 to 5, at the innermost inlet end 66, the dip tube 44 is open at a first inlet opening 117. As shown in the preferred embodiments, the first inlet opening 117 at the inlet end 66 on the inner tube portion 116 lies in a flat planar first inlet plane 124 intersecting with the center axis 101. This first inlet plane 124 preferably intersects with the center axis 101 forming an acute angle F with the center axis 101. The acute angle F shown as being an angle of 45° with the center axis 101, the acute angle F can be in the range of 45 to 90 degrees and, more preferably, in the range of 45° to 75°. As can best be seen in FIGS. 3 to 5, an axially inwardly directed touchdown foot surface 118 is carried on the innermost inlet end 66 of the tubular member 100. This touchdown foot surface 118 is disposed asymmetrically about the center axis 101 and is spaced on a radially rearward lateral side 119 from the center axis 101 over a limited circumferential extent of the center axis 101. The touchdown surface 118 is located spaced farther axially inwardly than any other surfaces of the tubular member 100. The purpose of the touchdown foot 118 is to become a first surface that engages with the bottom wall 98 of the reservoir 24. In engagement between the touchdown foot surface 118 and the bottom wall 98 of the reservoir, axial forces are applied axially parallel the center axis axially upwardly. Such axial forces are transferred asymmetrically to the tubular member 100 relative to the center axis 101 thus attempting to deflect the tubular member 100 to bend radially outwardly on a lateral side opposite from the lateral side 119 on which the touchdown foot surface 118 is provided on and assisting in creating the threshold tension forces over the frangible portion 114 on the lateral side 120 of the tubular member 100 opposite the lateral side 119. The touchdown surface 118 need not be provided in any flat plane or as part of the first inlet opening.

In a preferred arrangement as illustrated in FIG. 5, the touchdown foot surface 118 is provided in the first inlet plane 124 and the annular groove 113 lies is disposed in a groove plane 122 is provided in the groove plane 122 with the first inlet plane 124 and the groove plane 124 intersecting. As seen in FIG. 5, the first inlet plane 124 and the groove plane 122 intersect forming an acute angle G. Preferably, the first inlet plane 124 and the groove plane 122 intersect forming the acute angle G therebetween in the range of 90° to 30°. This relationship between the first inlet plane 124 and the groove plane 122 is preferred but not necessary. For example the first inlet plane 124 and the groove plane 122 may be parallel, for example, each at a same angle, say 45 degrees to the center axis 101, or the first inlet plane 124 and the groove plane 122 may intersect forming the acute angle G therebetween less than 30 degrees.

In accordance with the present invention, the dip tube 44 and its tubular member 100 is preferably substantially rigid against compression or deflection. Preferably, the dip tube 44 and its tubular member 100 is formed as an integral element from plastic material as preferably by injection molding. The material, preferably plastic material from which the dip tube 44 is formed, can be selected to suitably provide the frangible portion 114 to break by the application of suitable forces with engagement between the bottom wall 98 and the innermost inlet end 66 and with suitable selection of the rigidity to assist in developing axial tension forces across the frangible portion 114.

While not necessary, the dip tube 44 can be secured to the pump 42 in a desired angular orientation relative to the central axis 101, as by frictional engagement between the pump 42 and the outlet end 66 of the dip tube 44 resisting relative rotation or possibly by a keying mechanism to couple the outlet end 66 of the dip tube 44 to the pump against relative rotation about the center axis 101. As seen in the case of a dispenser of FIGS. 1 to 3, with the pump assembly secured to the housing 20 against relative rotation about a vertical axis by securing the dip tube 44 to the pump in a desired angular orientation relative to the central axis, the dip tube 44 will be in a fixed angular rotation relative to housing 20. For example, as seen in FIG. 9, this can provide for the touchdown foot surface 118 to be in the first inlet plane 124 with the first inlet plane 124 rising upwardly as it extends forwardly relative to the housing, as can be advantageous for engagement by the bottom wall 98 with the bottom wall 98 disposed at an angle rising upwardly as it extends forwardly relative to the housing as seen in FIG. 9. In the embodiment of FIGS. 1 to 3, the reservoir 24 is guided by engagement between the side walls 28 and 30 of the housing 20 to ensure that the reservoir 24 is in a desired angular orientation relative to the housing 20. Providing for the dip tube 44 and the reservoir 24 to engage in a desired orientation can be used towards selecting the relative angles for the first inlet plane 124 and/or the groove plane 122 relative the center axis 101 to provide advantageous severing of the frangible portion 114. In the embodiments as illustrated in FIGS. 11 and 12, the support member 36 also serves as a locating mechanism to relatively locate the pump assembly 22 and the reservoir 24 relative to each other in a desired pumping position for operation of the pump and in which, in the desire pumping position, the dip tube 44 extends into a reservoir cavity formed within the reservoir 24 through the upper reservoir opening 86 and downwardly from the outlet end 66 of the dip tube 44 towards the upwardly directed interior bottom surface 97 of the bottom wall 98 a desired extent for operation of the pump to draw fluid from the reservoir 24 via the dip tube 44.

Reference is made to FIG. 3 which, in broken lines, shows a modification of a piston chamber-forming body 46 of the pump 42 so as to provide an enlarged radially extending flange portion 46' which extends radially outwardly from the center axis 101 beyond an upwardly extending cylindrical neck 25 of the reservoir 24 about the opening 86. The flange 46' is fixed to the dip tube 44 and serves the function of preventing the reservoir 24 from being moved axially upwardly relative to the dip tube 44 beyond a desired position and thus, for example, if used in the context of an arrangement such as in FIG. 12 would prevent the accidental upward movement of the longer reservoir 24 beyond the desired position as may give rise to severing the frangible portion 114 when this is not desired or intended. The flange 46' interacts with the reservoir 24 to provide another locating mechanism to relatively locate the pump assembly 22 and the reservoir 24 relative to each other in a desired pumping position.

The pump assembly 22 when coupled to the reservoir 24 in either the condition shown in FIG. 11 or 12 has the reservoir opening 86 of the reservoir 24 is not sealably engaged to the pump assembly 22 so as to permit atmospheric air to enter the reservoir 24 in replacement of fluid in the reservoir that is displaced by operation of the pump without vacuum conditions arising in the reservoir, and a non-collapsible bottle to be used as the reservoir.

With the pump assembly 22 coupled to the reservoir 24 as in the condition shown in FIG. 11 in combination they together form a removable cartridge 200 which can be removed from the dispenser 10 by pivoting the nozzle shield 34 to a raised position and sliding the cartridge 200, comprising both the pump assembly 22 and the reservoir 24 forwardly. Similarly, such a cartridge 200 comprising the pump assembly 22 coupled to the reservoir 24, can be inserted into the dispenser 10 while the nozzle shield 34 is in a raised position. The cartridge 200 comprising the pump assembly 22 is coupled to the reservoir 24 as in the condition shown in FIG. 11 may be modified to provide another mechanism for coupling the reservoir 24 to the pump assembly 22, such as a threaded collar carried on the piston chamber forming body 46 which removably engages with a threaded neck 25 of the reservoir 24.

Figure 14:
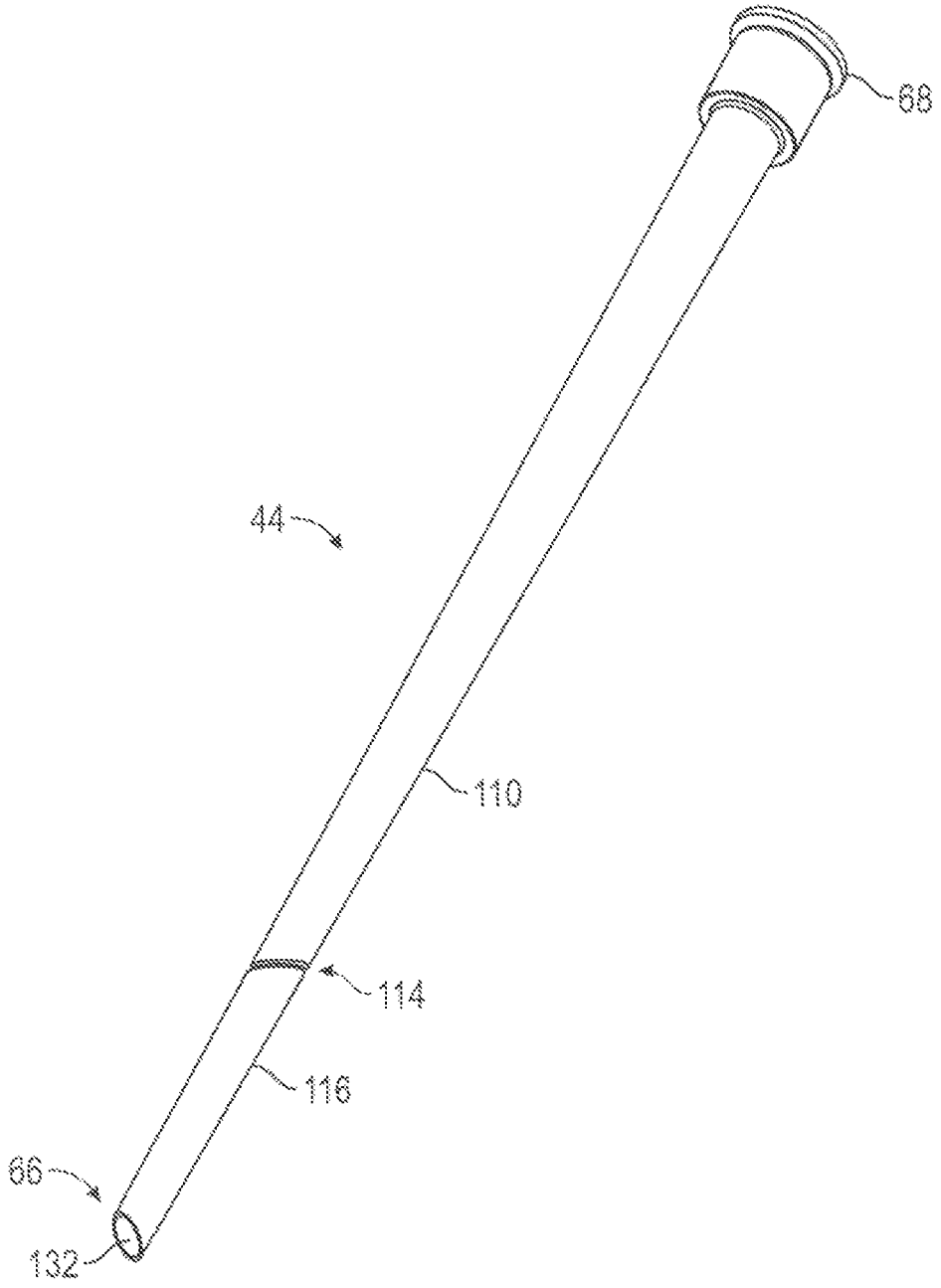
FIG. 14 is a perspective view of a second embodiment of a dip tube in accordance with the present invention.
Figure 15:
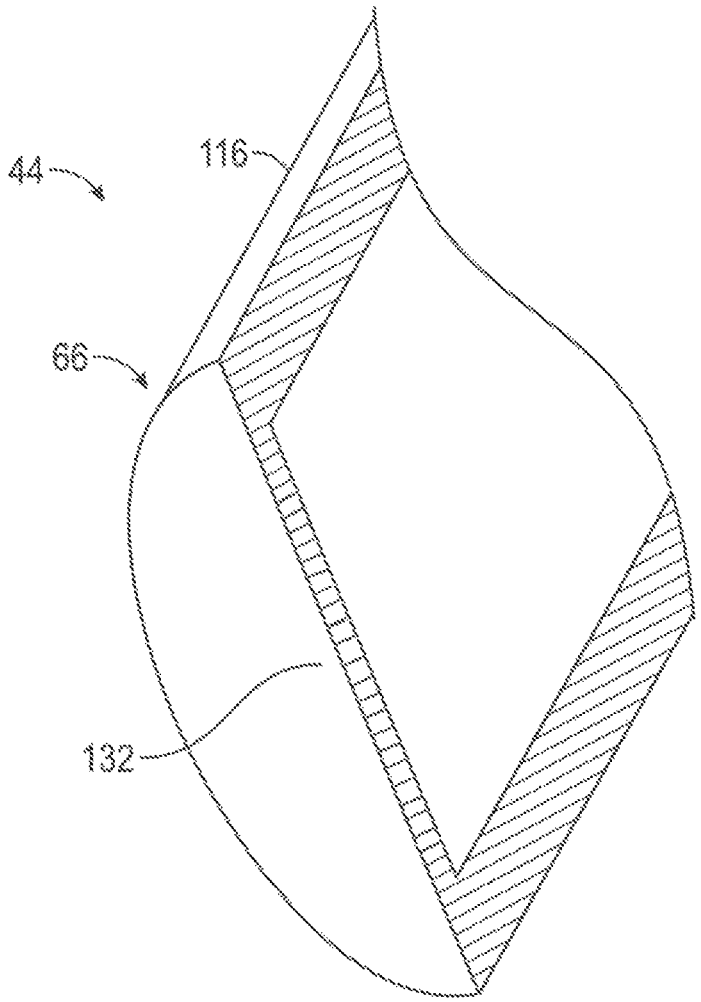
FIG. 15 is an enlarged cross-sectional view of an inner end of the dip tube of FIG. 14.
Figure 16:
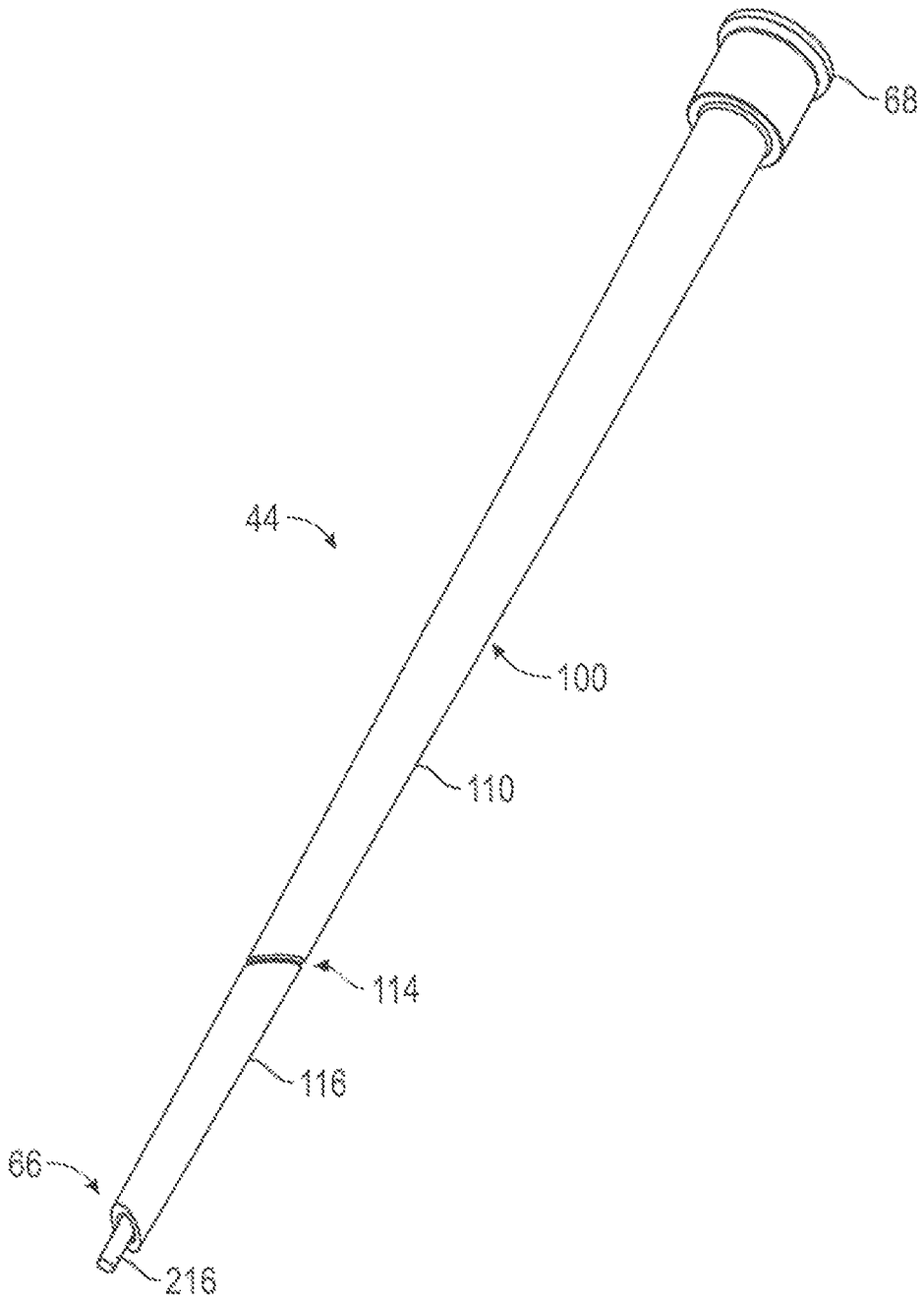
FIG. 16 is a perspective view of a third embodiment of a dip tube in accordance with the present invention.
Figure 17:
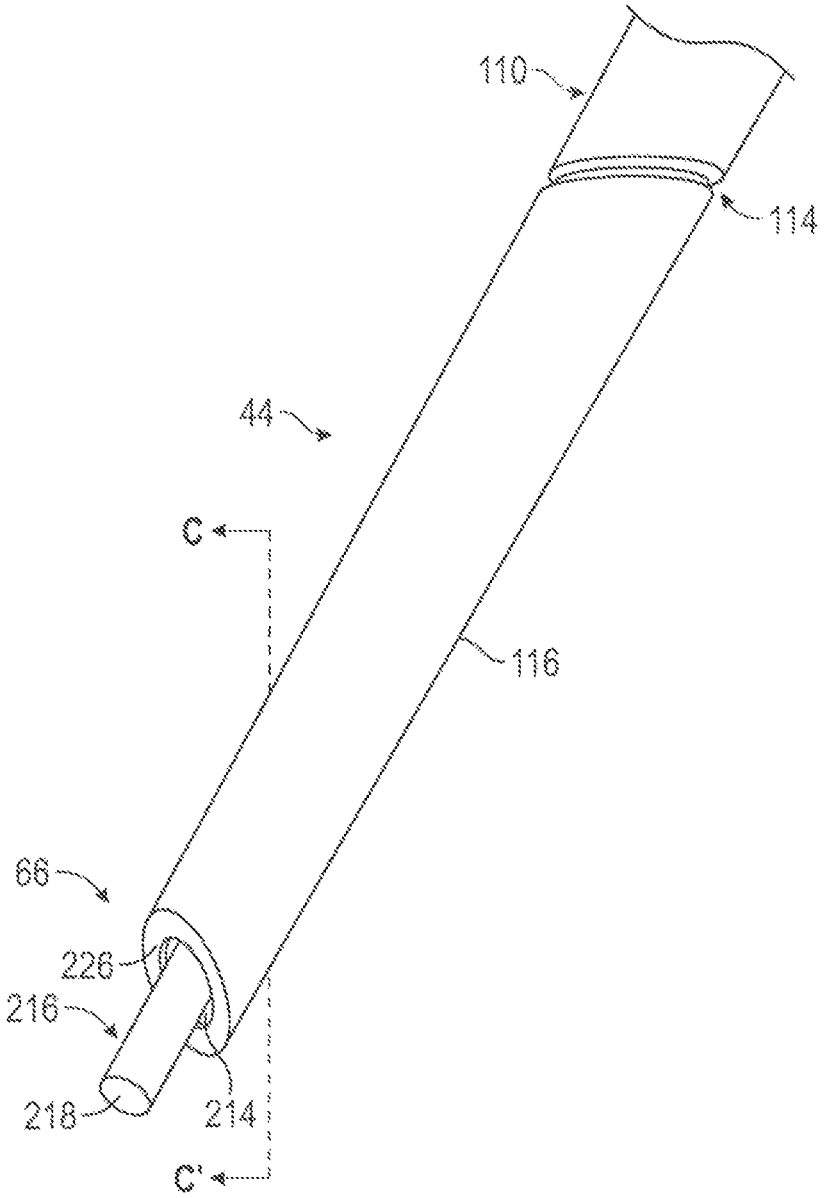
FIG. 17 is an enlarged pictorial view of an inner end of the dip tube of FIG. 16.

Reference is made to FIGS. 14 and 15 illustrating a dip tube 44 in accordance with a second embodiment of the invention.

In the first embodiment, as seen in FIG. 4, for example, the innermost inlet end 66 on the inner tube portion 116 is open at a first inlet opening 117. The dip tube 44 in the second embodiment differs from the dip tube 44 of the first embodiment firstly in not having the opening 117 but rather having the innermost inlet end 66 closed by an end wall 132. In the first embodiment, the dip tube included a locking member 70 in the form of fingers 74 and 76 as will be described later. The dip tube 44 in the second embodiment also differs from the dip tube 44 of the first embodiment, by reason that the dip tube 44 in the second embodiment does not include any such optional locking member 70.

As can be seen in FIGS. 14 and 15, the innermost inlet end 66 is closed by the end wall 132 forming a closed blind end to the inner tube portion 116. The dip tube 44 of the second embodiment is to be inserted into a short form of the reservoir 44 as illustrated in FIGS. 8 to 11 with the result that the frangible portion 114 would become broken and with the frangible portion 114 broken, the intermediate inlet opening 112 is formed at the intermediate inlet end 113 on the outer tube portion 110 proximate the bottom wall of the reservoir 24 for drawing of fluid from the reservoir 24. In the second embodiment, the dip tube 44 with its inlet end 66 closed an end wall 132 and the frangible portion 114 intact can be visually examined to see if it has been previously used. The dip tube 44 of the second embodiment would be useful with the short form of the reservoir 24 as illustrated in FIGS. 7 to 11 but would not functional with the long form of the bottle as shown in FIG. 12.

Reference is made to FIGS. 16 to 20 which illustrate a third embodiment of a dip tube 44 in accordance with the present invention. The dip tube 44 of the third embodiment is substantially identical to the dip tube 44 of the second embodiment of the invention, however, with the innermost end 66 having an inlet opening 117 which is closed by an inner plug member 216 and an annular frangible bridge member 214. The plug member 216 is joined to the inner tube portion 116 by an annular frangible bridge member 214 bridging between the inner tube portion 116 of the tubular member 100 and the plug member 216. The plug member 216 has an axially innermost touchdown end 218 and extends from the touchdown end 218 to an axially outer plug end 220, preferably as a solid rod, with an exterior side surface 222 extending from the outer plug end 220 to the touchdown end 218.

With the annular frangible bridge member 214 intact, the frangible bridge member 214 couples the inner tube portion 116 of the tubular member 100 and the plug member 216 together with the touchdown end 218 of the plug member 216 disposed axially inwardly of the innermost inlet end 66 of the inner tube portion 116 of the tubular member 100. The frangible bridge member 214 bridges between the inner tubular portion 116 and the exterior side surface 222 of the plug member 216 with the frangible bridge member 214 and the plug member 216 sealably closing the inlet opening 117 to fluid flow therethrough. The frangible bridge member 214 is selected such that, while the frangible bridge member 214 is intact, on the application of an axial threshold compression force to the touchdown end 218 of the plug member 216 urging the plug member 216 axially towards the outlet end 68 across the frangible bridge member 214, the frangible bridge member 214 breaks and the plug member 216 is displaced axially outwardly into a passageway 300 within the inner tube portion 116 of the tubular member 100 through the inlet opening 117 thereby opening the inlet opening 117 for passage of fluid axially inwardly therethrough.

Figure 18:
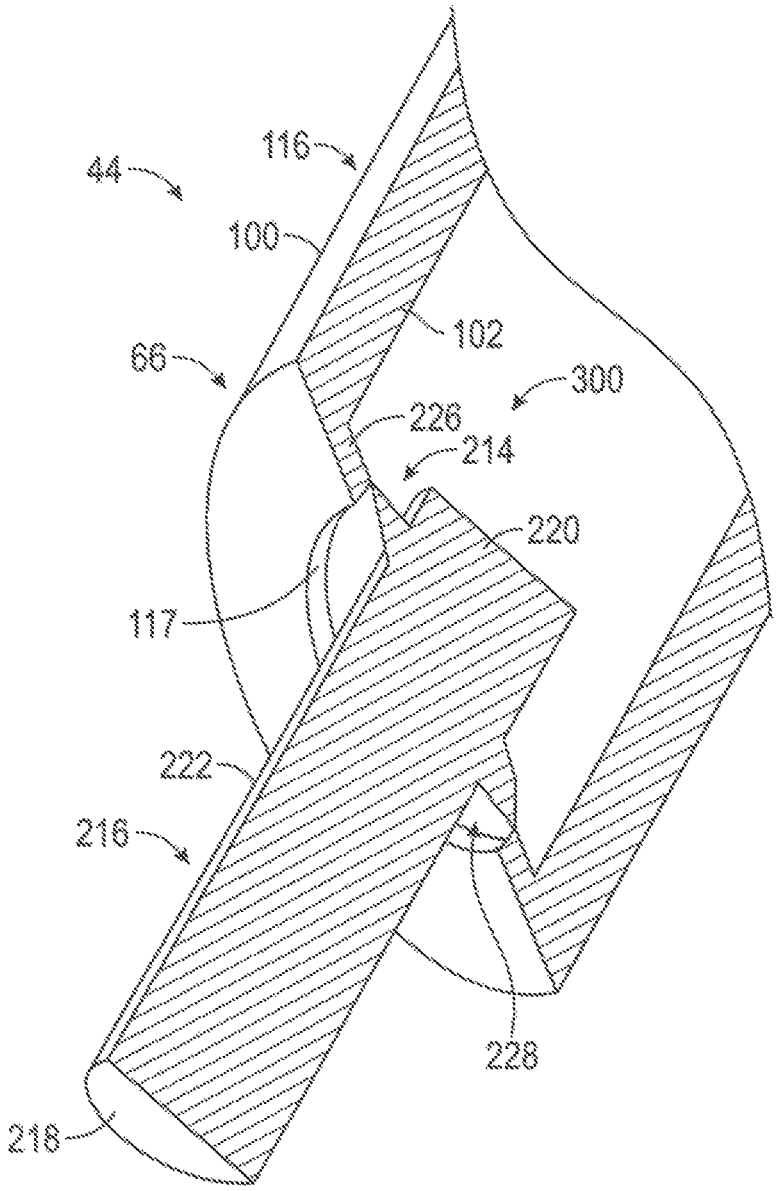
FIG. 18 is an enlarged cross-sectional side view of the dip tube in FIG. 17 along section line C-C' in FIG. 17.
Figure 19:
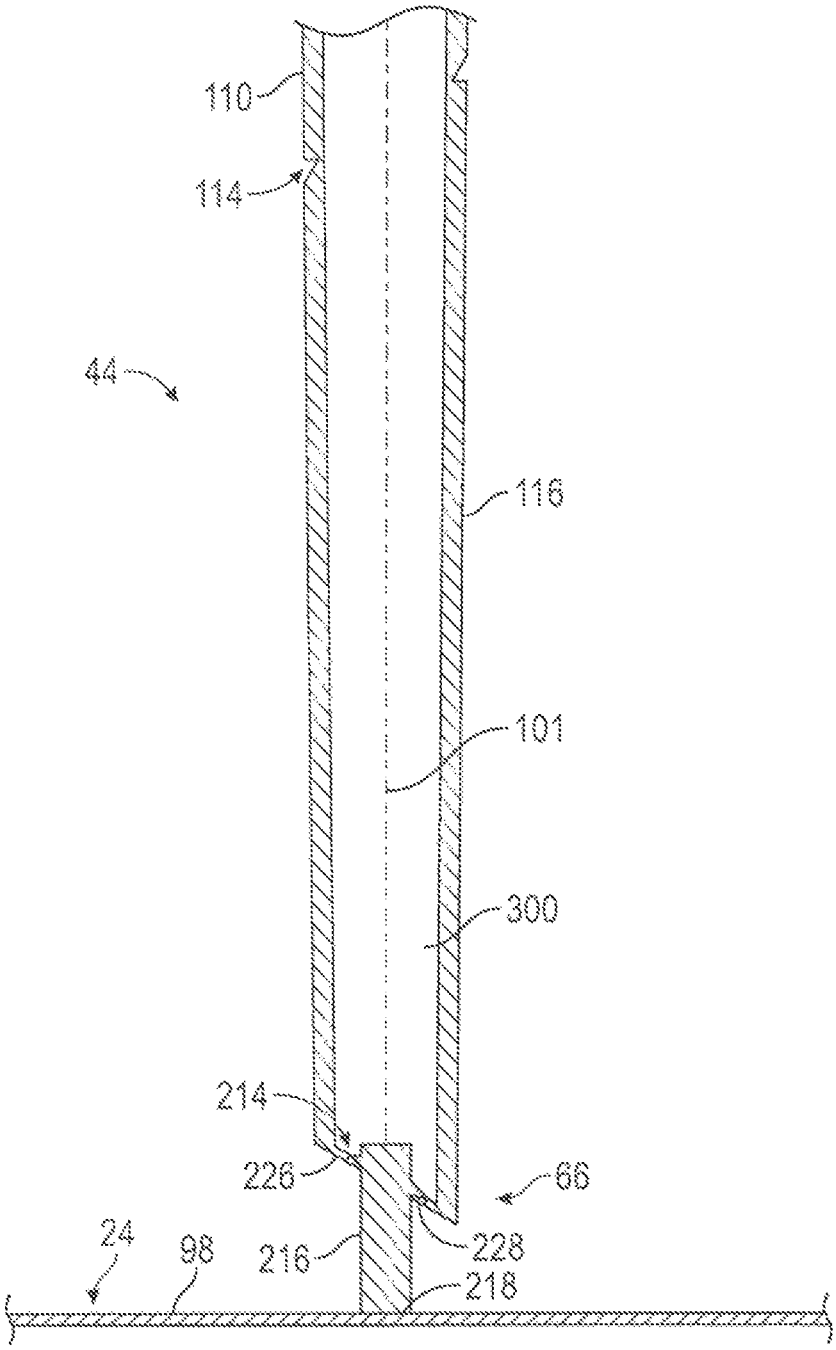
FIG. 19 is a schematic vertical cross-sectional view showing an inner portion of the dip tube of FIG. 17 in initial engagement with a bottom of a fluid reservoir.

As best seen in FIG. 18, at the innermost inlet end 66, a radially inwardly extending annular end flange 226 extends radially inwardly from tube wall 102 and merges into the side surface 222 of plug member 216. The annular frangible bridge member 214 is provided as an annular groove 228 in the end flange 226 over which groove 228 the axial thickness of the flange 228 is reduced such that the frangible bridge member 214 will selectively sever when the threshold compression forces are applied axially to the touchdown end 218 of the plug member 216. As schematically shown in FIG. 19, on the touchdown end 218 engaging the bottom wall 98 of a reservoir 24 not otherwise shown, when sufficient axial compression forces are applied, the frangible bridge member 216 will rupture forcing the plug member 216 axially outwardly and upwardly into the inner tube portion 116. With a diameter of the passageway 300 within the inner tube portion 116 axially outwardly from the first inlet opening 117 being larger than a diameter of the first inlet opening 117, the plug member 216 while within the passageway 300 as seen in FIG. 20 does not block fluid flow through the passageway 300 but rather permits fluid flow through the passageway 300 axially therethrough and past the plug member 216.

Figure 20:
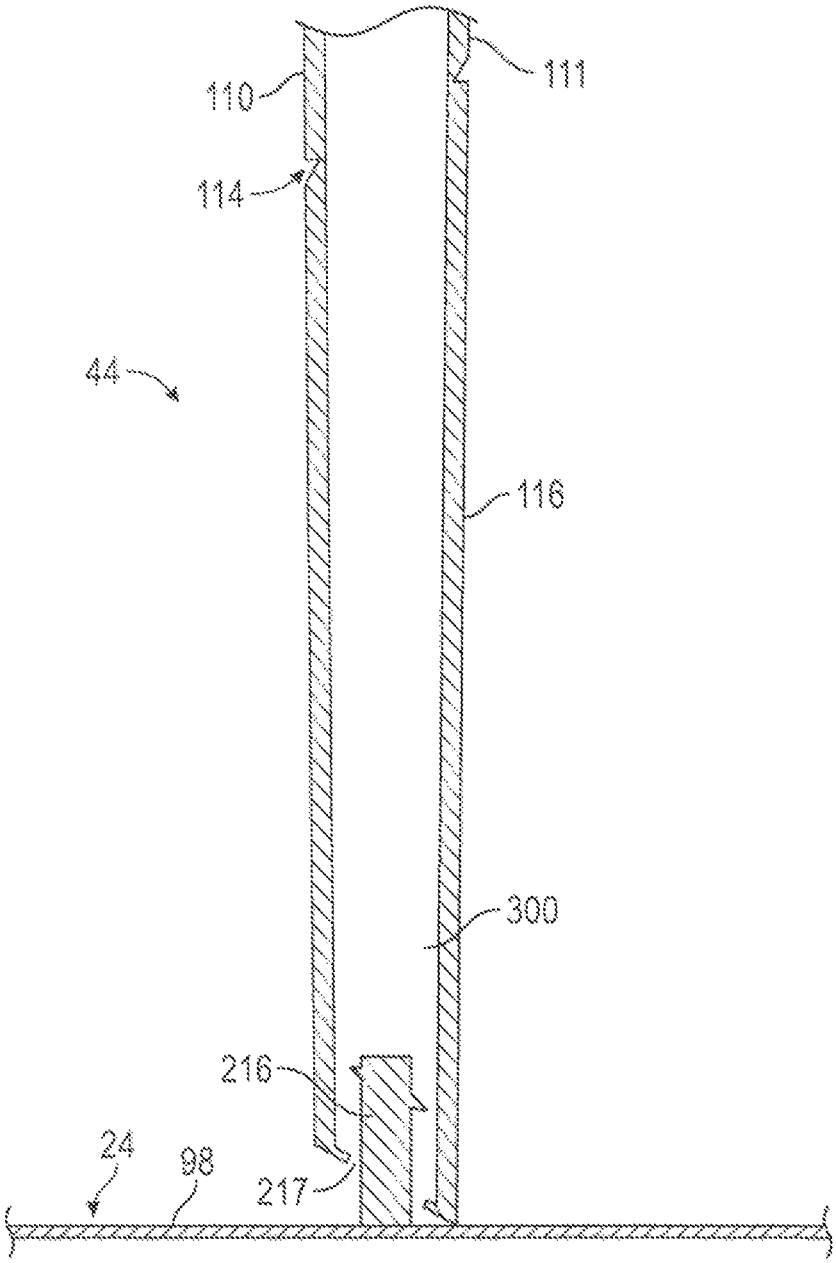
FIG. 20 is a cross-sectional side view the same as FIG. 19, however, illustrating a condition in which the dip tube has been forced into engagement with the bottom of the reservoir to sever a frangible portion and permit a plug portion to be displaced axially outwardly into the dip tube.

As seen in FIG. 20, with breaking of the frangible bridge member 216, the inner tube portion 116 of the tubular member 100 has been moved relatively towards the bottom wall 98 compared to FIG. 19.

While not necessary, the touchdown end 218 of the plug member 216 is preferably centered coaxially with the centre axis 101 and also disposed in a flat plane that is normal to the center axis 101, forming an angle of 90 degrees with the center axis 101, each of which can be advantageous for engagement between the touchdown end 218 and the bottom wall 98 of the reservoir 24 to apply compressive forces symmetrically centered relative the center axis 101 and tending to urge the plug member 216 coaxially outwardly relative the tubular member 100. While not necessary, preferably, the annular end flange 226 is disposed in a flat plane forming an acute angle less than 90 degrees with the center axis 101.

In the position of FIG. 20, the dip tube 44 is disposed in an operative condition ready to draw fluid as from a long form of the reservoir 24 similar to the condition in FIG. 12 with the first embodiment. If, however, from the position shown in FIG. 20, the bottom wall 98 of the reservoir 24 is sufficiently moved upwardly relative the dip tube 44, the dip tube 44 will come to be severed at the frangible portion 114 as in the embodiment illustrated in FIGS. 1 to 11 with use of the short form of the reservoir 24 as shown in the sequence of FIGS. 8 to 11, and when a condition as shown in FIG. 11 is reached, fluid may be drawn through the intermediate inlet opening 112 at the intermediate inlet end 111 on the outer tube portion 110.

The third embodiment illustrated in FIGS. 16 to 20 includes both the frangible portion 114 and the frangible bridge member 214. In a further fourth embodiment of the invention, the third embodiment is modified to eliminate the frangible portion 114 by eliminating the groove 113 such that the outer tube portion 110 and the inner tube portion 116 form but a single tube portion extending as the tubular member from the innermost inlet end 66 to the outlet end 68 preferably with a relatively constant thickness tube wall 102. In this fourth embodiment, the dip tube 44 would be intended for insertion into a bottle merely for engagement of the bottom wall 98 of the reservoir 24 in a manner as illustrated in FIGS. 19 and 20 and without the added feature of being able to reduce the length of the tubular member 100 by severance in between the innermost inlet end 66 to the outlet end 68.

Figure 21:
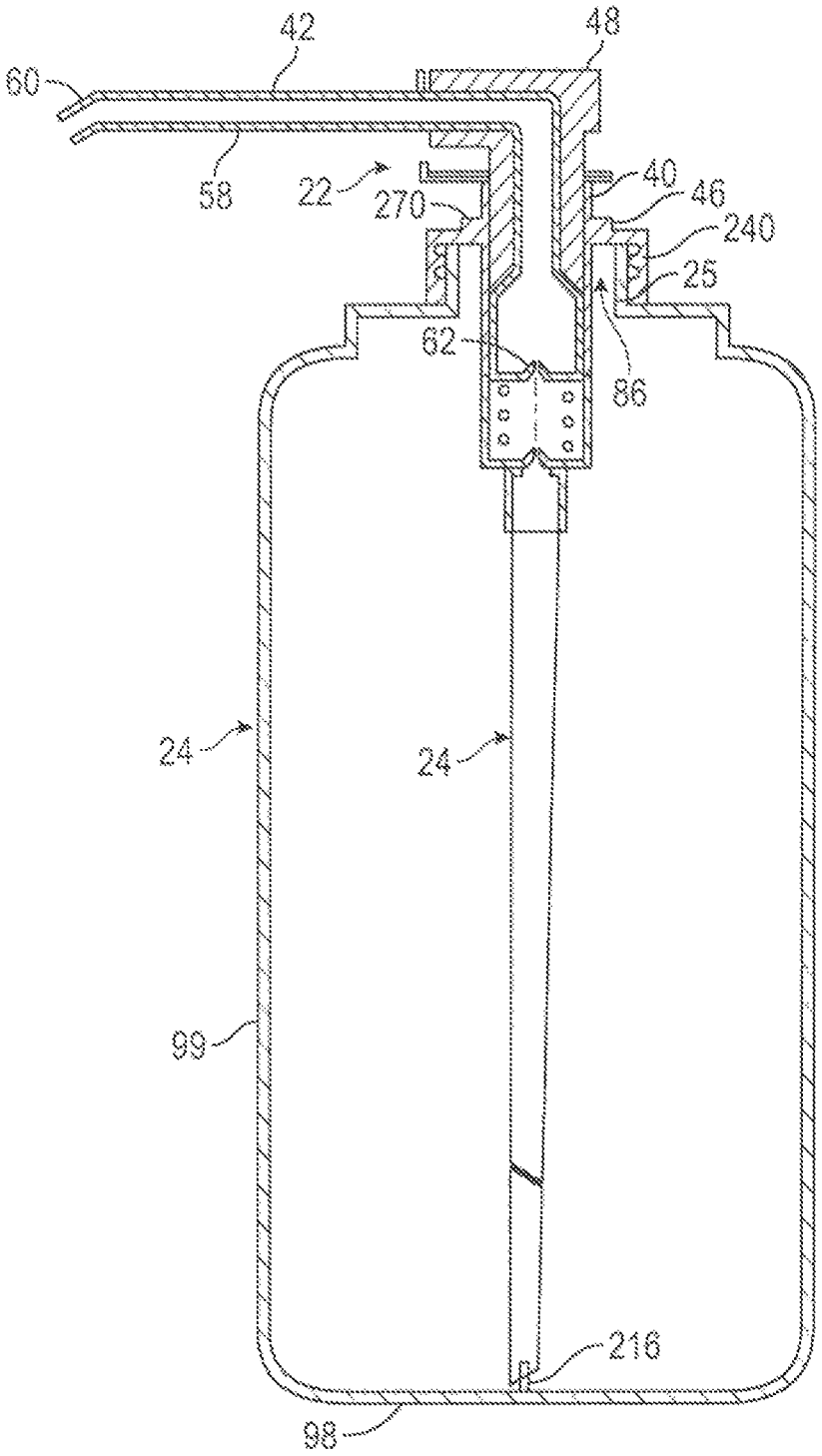
FIG. 21 is a cross-sectional side view showing a third embodiment of a pump assembly in combination with a fluid reservoir.

Reference is made to FIG. 21 which shows a fifth embodiment of the invention and shows an alternate arrangement for coupling of the pump assembly 22 to the reservoir 24. As illustrated in FIG. 21, an upwardly extending cylindrical threaded neck 25 about the upwardly directed reservoir opening 86 has external threads for engagement with internal threads on a downwardly extending annular threaded collar 40 secured to the piston chamber-forming body 46. A vent port 270 is preferably provided as one venting arrangement to provide communication between the reservoir 24 and the atmosphere.

In the embodiment of FIG. 21, on threading the collar 240 downwardly onto the threaded neck 25 of the reservoir from a partially engaged condition not shown to the fully seated condition shown in FIG. 21, the dip tube 24 is moved axially from being spaced above the bottom wall 98 as shown in FIG. 19 to becoming engaged the bottom wall 98 as shown in FIG. 20. In the embodiment of FIG. 21, engagement between the threaded neck 25 and the threaded collar 240 serves as a locating mechanism to relatively locate the pump assembly 22 and the reservoir 24 relative to each other in desired positions, including in the fully sealed condition shown which provides a desired pumping position for operation of the pump and in which, in the desire pumping position, the dip tube 44 extends into the reservoir 24 through the upper reservoir opening 86 and downwardly from the outlet end 66 of the dip tube 44 towards the upwardly directed interior bottom surface 97 of the bottom wall 98 a desired extent.

The embodiment of FIG. 21 can serve as another cartridge comprising the reservoir 24 and pump assembly as pre-assembled for insertion into a dispenser as illustrated in FIGS. 1 to 3. The embodiment of FIG. 21 could also be used as a standalone manual dispenser as with the reservoir 24 supported on a table top and activated by a user pressing on a piston forming element 48 of the pump.

The present invention provides a method of inserting dip tube 44 into a fluid reservoir 22 as described with engagement of the inner end of the dip tube 44 breaking one or more of the frangible portion 114 or the frangible bridge member 214 to alter a characteristic of the dip tube 44. In each of the embodiments, the dip tube 44 could prior to insertion be manually manipulated by a user to break either or both of the frangible portion 114 or the frangible bridge member 214 and to then insert the dip tube 44 into the reservoir 24. However, manually reducing the length of the dip tube 44 as in the case of the embodiment of FIG. 12 by breaking the frangible portion 114 before insertion of the dip tube 44 into a long form of the reservoir would result in a mis-matching of the broken and shortened dip tube 44 and its inadvertent, mistaken placement into the long form of the reservoir 24.

The first embodiment of FIGS. 1 to 11 illustrate the dip tube 44 combination of the fluid pump 42 and the reservoir 24 with a locating mechanism to locate the pump assembly 22 in a desired pumping position relative the reservoir 24 for operation of the pump 42. The locating mechanism is provided by the housing 20 which, on one hand via the upper plate 32, locates the pump assembly 22 and, on the other hand via the support member 36, relatively locates the reservoir 24. In the desired pumping position of FIG. 12, with the frangible portion 114 broken, the dip tube 44 extends into the reservoir cavity 25 downwardly from the outlet end 68 of the dip tube 44 towards the bottom surface 97 of the bottom wall 98 a desired extent for placement of the intermediate inlet opening 112 proximate the bottom surface 97 for operation of the pump.

FIG. 11 shows an inoperative position in which the pump assembly 22 is located relative the reservoir 24 above the desired pumping position of FIG. 12 with the frangible portion 114 intact and extending downwardly into the reservoir 24 to locate the inlet end 66 of the dip tube 44 within the reservoir 24 above and engaged with the upwardly directed bottom surface 97 of the bottom wall 98. Relative movement of the reservoir 24 of the pump assembly 22 from the inoperative position to the desired pumping position results in the inlet end 66 of the dip tube 44 and the bottom surface 97 of the bottom wall engaging producing the tension force between the inner tube portion 116 and the outer tube portion 110 across the frangible portion 114 to break the frangible portion.

In the embodiment of FIG. 21, FIG. 21 illustrates a desired pumping position. In the embodiment of FIG. 21, the locating mechanism to locate the pump assembly 22 in the desired pumping position relative to the reservoir 24 for operation of the pump 42 is the threaded neck 25 of the reservoir and the threaded collar 40 on the piston chamber-forming body 46 of the pump assembly. FIG. 19 illustrates an inoperative position of the embodiment of FIG. 21.

The internal structure of the pump 42 is best shown in FIG. 3. The pump 42 includes a piston chamber forming body 46 and a piston forming element 48. The piston chamber-forming body 46 is fixed to the housing 20 against movement through the coupling of the collar region 40 to the upper plate 32. The piston chamber-forming body 46 carries and defines a piston chamber 50 and a dip tube coupling element 52 coaxially about a vertical axis. The piston forming element 48 is mounted to the piston chamber-forming body 46 for relative vertical movement, with a piston 54 of the piston-forming element 48 coaxially slidable within piston chamber 50. The piston 54 is biased upwardly by spring 56 disposed within the piston chamber 50 between the piston chamber 50 and the piston 54. Depression of the lever 14 moves the piston-forming element 48 downwardly relative to the piston chamber-forming body 46 against the bias of the spring 56.

The piston-forming element 48 includes a hollow discharge spout tube 58 that extends from the piston 54 to a pump outlet 60. The piston 54 sits snuggly within the piston chamber 50, and is provided with a one-way outlet duckbill valve 62 which permits fluid to flow upwardly into the piston 54 from the piston chamber 50, and prevents fluid from flowing out of the piston 54 into the piston chamber 50.

The piston chamber 50 defines a cylindrical cavity within which the piston 54 is reciprocally coaxially slidable between a retracted position and an extended position to discharge fluid from the reservoir 24 out the pump outlet 60. A one-way inlet duckbill valve 64 sits between the piston chamber 50 and the dip tube coupling element 52, and permits fluid to flow upwardly into the piston chamber 50 from the dip tube coupling element 52, and prevents fluid from flowing out of the piston chamber 50 into the dip tube coupling element 52.

A liquid compartment 51 is defined within the piston chamber 50 between the lower end of piston 54 carrying the one-way outlet duckbill valve 62 and the lower end of the piston chamber 50 carrying the one-way inlet duckbill valve 64. The volume of the liquid compartment 51 varies as the piston 54 moves between the retracted position and the extended position.

The dip tube coupling element 52 is adapted for coupling to the dip tube 44, to place the pump 42 in fluid communication with the dip tube 44. The dip tube coupling element 52 is formed as a hollow suction tube extending downwardly from the piston chamber 50, and sized to fit in a sealed, friction fixed engagement within the outlet end 68 of the dip tube 44 such that friction holds the dip tube coupling element 52 and the dip tube 44 together in a coupled state against disengagement.

When in the pumping configuration shown in FIG. 12, with the pump outlet 60 external to the reservoir 24 and the innermost inlet end 66 of the dip tube 44 in communication with fluid 16 in the reservoir 24, the pump assembly 22 is operated in a retraction stroke by depressing the lever 14, which causes the piston 54 to slide downwardly from the extended position toward the retracted position within the piston chamber 50. The movement of the piston 54 towards the retracted position reduces the volume of the liquid compartment 51, pressurizing the fluid 16 in the liquid compartment 51, forcing the fluid 16 upwards through the duckbill valve 62 through the hollow spout tube 58 and out the pump outlet 60.

When the lever 14 is released, in a withdrawal stroke the spring 56 pushes the piston 54 back up to its extended position. The movement of the piston 54 towards the extended position increases the volume of the liquid compartment 51, reducing the pressure within the liquid compartment 51, which draws fluid 16 into the liquid compartment 51 from the reservoir 24 via the dip tube 44 and dip tube coupling element 52 through the valve 64. Thus, in a cycle of operation involving a retraction stroke and a withdrawal stroke, fluid is drawn from the reservoir 24 and dispensed out the pump outlet 60.

To reduce the risk of contamination, the dip tube 44 and the fluid reservoir 24 are preferably to be disposed of and replaced once the fluid 16 contained within the fluid reservoir 24 has been depleted. To prevent the dip tube 44 and the fluid reservoir 24 from being reused, an optional locking member 70 is provided which is best shown in FIGS. 2 and 3. The locking member 70 is coupled to the dip tube 44.

As best seen in FIGS. 2 and 3, the locking member 70 includes two elongated fingers 74 and 76 extend from the annular ring 72 from a lower proximal first end 78 to an upper distal second end 80. The upper distal second end 80 is provided with an upwardly directed stop surface 82. Each finger 74 and 76 extends radially outwardly as they extend axially upwardly such that the upper distal second end 80 is a greater radial distance from the dip tube 44 than the lower proximal first end 78.

The fluid reservoir 24 as best shown in FIG. 3 in broken lines has a top wall 23 carrying the upwardly directed reservoir opening 86 at an upper end of the upwardly extending cylindrical neck 25 disposed about a vertical reservoir axis. The cylindrical neck 25 is supported and merges at its lower end into a radially outwardly extending top wall flange 29 generally normal to the reservoir axis which extends radially outwardly from the neck 25 to merge with a cylindrical downwardly extending annular wall 27 whose lower end merges outwardly and downwardly into the side wall 99. The interior surface of the top wall flange 29 provides an axially inwardly, that is, downwardly directed stopping shoulder. The stopping shoulder is an inwardly, downwardly facing flat surface that surrounds the reservoir opening 86 within the reservoir 24.

The locking member 70 is coupled to the dip tube 44 such that as the dip tube 44 is inserted through the opening 86 of the fluid reservoir 24 into the fluid reservoir 24, the locking member 70 is also inserted through the opening 86 of the fluid reservoir 24 into the fluid reservoir 24 in a manner as shown by the sequence illustrated in succession in respect of the entire dispenser 10 by FIGS. 7 to 11. Once the dip tube 44 with the locking member 70 are within the reservoir 24 as seen in FIG. 11 and also in FIG. 12, the removal of the dip tube 44 and the locking member 70 is prevented by engagement of the locking member 70 with the reservoir 24.

FIGS. 11 and 12 show conditions when the pump assembly 22 is fixed to the housing 20 against axial movement and the pump assembly 22 is coupled to the dip tube 44 with the dip tube 44 and the locking member 70*s* within the reservoir 24. FIGS. 11 and 12 also illustrate a pumping configuration in which the reservoir 24 is supported on the support member 36 of the housing 20. From the condition of FIG. 11 or 12, if a user may try to remove the reservoir 24 from the pump assembly 22, the user manipulates the reservoir 24 to draw it forwardly off the support member 36 of the housing 20 and then applies forces to the reservoir 24 to draw the reservoir 24 downwardly such that the reservoir 24 will move from the condition of FIG. 11 or 12, in which the locking member 70 is not in engagement with the reservoir 24, to a condition in which the locking member 70 engages the reservoir 24 and prevents removal of the dip tube 44 from the fluid reservoir 24. If sufficiently great axially directed forces are applied to the reservoir 24 drawing the reservoir 24 and the pump assembly 22 axially apart, then the frictional engagement of the dip tube 44 and the dip tube coupling element 52 will be overcome, and the dip tube 44 will disengage from the dip tube coupling element 52; and the pump 42 becomes separated from the reservoir 24 with the dip tube 44 and the locking member 70 to remain within the reservoir 24.

When the dip tube 44 and the locking member 70 are disposed inside the fluid reservoir 24 the upwardly directed stop surface 82 of each finger 74 and 76 is directed into opposition with the stopping shoulder of the fluid reservoir 24, such that engagement of the stop surfaces 82 with the stopping shoulder prevents the locking member 70, and the dip tube 44 coupled thereto, from being extracted from the reservoir 24 through the reservoir opening 86.

The dip tube coupling element 52 and the dip tube 44 are held together by friction, and are configured to uncouple upon application of a sufficient force pulling the dip tube 44 axially downwardly away from the pump 42. The degree of force required is preferably selected to be less than the force that would be required to fracture the locking member 70, or to otherwise detach the locking member 70 from the dip tube 44. This ensures that any attempt to forcibly detach the pump 42 from the reservoir 24 will result in the uncoupling of the dip tube 44 from the pump 42. With the dip tube 44 removed from the pump 42, the pump 42 can no longer be used to pump fluid 16 from a reservoir 24. In particular, the dip tube 44 is required to place the pump 42 in communication with fluid 16 contained within a fluid reservoir 24. As such, the uncoupling of the pump 42 from the dip tube 44 prevents the pump assembly 22 from being reused. To continue using the fluid dispenser 10 once the fluid 16 within the reservoir 24 has been depleted, it is typically desirable to replace the pump assembly 22 with a new pump assembly 22 including a dip tube 44. This reduces the risk of contamination which might otherwise occur if the pump assembly 22 was reused.

The locking member 70 is adapted to permit the dip tube 44 to be inserted through the reservoir opening 86 into the reservoir 24 while the locking member 70 is coupled to the dip tube 44. In particular, the fingers 74 and 76 are resiliently deformable having an inherent bias to assume an unbiased condition as seen in Figure. When the fingers 74 and 76 are deflected from their unbiased condition, their inherent bias biases them to return to the unbiased condition. Each of the fingers 74 and 76 have a radially outwardly directed cam surface 93 that angles radially outwardly as it extends axially upwardly. Each cam surface 93 is adapted to engage with a radially inwardly directed camming surface formed by the lip of the reservoir opening 86 and the interior of the cylindrical neck 25, so as to deflect the fingers 74 and 76 radially inward toward the dip tube 44 when the dip tube 44 is being inserted by the inlet end 66 first into the reservoir 24 through the reservoir opening 86. This inward deflection of the fingers 74 and 76 permits the locking member 70 to pass through the reservoir opening 86 and into the reservoir 24. Once fully inserted within the reservoir 24, the fingers 74 and 76 deflect under their inherent bias to move radially outward from the dip tube 44 to their inherent unbiased condition assuming the locking configuration, wherein the stop surfaces 82 of the fingers 74 and 76 are positioned in opposition to the stopping shoulder, for locking the dip tube 44 within the reservoir 24. Since the stop surfaces 82 of the fingers 74 and 76 are spaced a distance greater than a diameter of the reservoir opening 86, the dip tube 44 is prevented from being extracted from the reservoir 24 through the reservoir opening 86.

While not shown, in anther embodiment of the invention the dip tube 44 and the dip tube coupling element 52 may be fixed together against disengagement and the pump 42 is provided with a frangible or weakened region which is configured to fracture when the pump 42 is pulled axially away from the reservoir 24, for example, with the piston chamber 50 having an annular weakened region that extends around the entire circumference of the piston chamber 50. The weakened region is configured to fracture when the pump 42 is pulled axially away from the reservoir 24. With the piston chamber 50 fractured, the pump 42 is no longer able to create the buildup of pressure required to force fluid 16 up through the duckbill valve 62 and out the pump outlet 60. This further ensures that the pump 42 cannot be reused and, for example, would prevent a user from attaching a new dip tube 44 to a previously used pump 42 to reuse the pump 42.

In yet another embodiment of the invention, the duckbill valve 64 is carried on the outlet end 68 of the dip tube 44 rather than on the piston chamber-forming body 46. When the outlet end 68 of the dip tube 44 is removed from the dip tube coupling element 52, the duckbill valve 64 is also removed, rendering the pump 42 inoperative upon uncoupling of the dip tube 44 from the pump 42.

Preferably, the fluid dispenser 10 of the present invention is used to dispense a hand cleaner such as hand soap or hand sanitizer. It is to be appreciated, however, that the fluid dispenser 10 could alternatively be used to dispense any desired fluid 16, such as hand cream, hair gel, toothpaste, food products or the like.

The pump 442, dip tube 44 and reservoir 24 may each be disposed of and replaced after each use. Preferably, the pump assembly 22, dip tube 44 and reservoir 24 are formed from relatively inexpensive materials, such as plastics, although any suitable materials could be used. If the pump assembly 22, dip tube 44 or the reservoir 24 are intended to be replaced after use to dispense the fluid within the reservoir 24 but once, it is not necessary for them to be constructed so as to withstand long periods of wear, or cleaning procedures such as autoclaving.

It is to be appreciated that the invention is not limited to the particular embodiments that have been described.

While the preferred embodiments have been illustrated as employing one particular form of piston pump 42, it is to be appreciated that many other possible types of pumps 42 could be used instead. For example, the invention could be used in association with the pumps 42 described and illustrated in U.S. Pat. No. 5,489,044 to Ophardt; U.S. Pat. No. 7,984,825 to Ophardt et al.; and U.S. Pat. No. 8,684,236 to Ophardt, which are incorporated herein by reference.

FIG. 1 shows a dispenser 10 that is activated manually to dispense fluid, however, the user of the dip tube of the present invention is not limited to manually operated dispensers and could be, for example, used in dispensers whose pumps are activated by an electric motor as in an automated operation as in a touchless dispenser.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein. For a definition of the invention, reference is made to the following claims.

We claim:

1. A dip tube comprising:

an elongate hollow tubular member extending from an innermost inlet end to an outlet end, the tubular member having a circumferential tube wall, the tube wall having an exterior surface and an interior surface and a thickness between the exterior surface and the interior surface, the tubular member having an outer tube portion, an intermediate tubular frangible portion, and an inner tube portion, the outer tube portion including the outlet end and extending from the outlet end to an intermediate inlet end on the outer tube portion, the inner tube portion including the innermost inlet end and extending from the innermost inlet end to an intermediate outlet end on the inner tube portion, the frangible portion bridging between the outer tube portion and the inner tube portion providing communication between the intermediate inlet end on the outer tube portion and the intermediate outer end on the inner tube portion, the frangible portion extending circumferentially about the tubular member, the frangible portion selected such that while the frangible portion is intact on application of a threshold tension force between the inner tube portion and the outer tube portion across the frangible portion the frangible portion breaks, with the frangible portion intact, the interior surface of the tube wall defining a sealed continuous long interior passageway through each of the outer tube portion, the frangible portion and the inner tube portion of the tubular member between an outlet opening at the outlet end on the outer tube portion and the innermost inlet end on the inner tube portion, with the frangible portion broken the interior surface of the tube wall over the outer tube portion defining a sealed continuous short interior passageway through the outer tube portion between the outlet opening at the outlet end on the outer tube portion and an intermediate inlet opening at the intermediate inlet end on the outer tube portion, the intermediate inlet opening open through the tube wall of the outer tube portion to the exterior surface of the tube wall at the intermediate inlet end.

2. A dip tube as claimed in claim 1 wherein the thickness of the tube wall over the frangible portion selected such that while the frangible portion is intact on the application of the threshold tension force between the inner tube portion and the outer tube portion across the frangible portion the frangible portion selectively breaks without the application of the threshold tension force between the inner tube portion and the outer tube portion damaging the inner tube portion and the outer tube portion.

3. A dip tube as claimed in claim 1 wherein the thickness of the tube wall over the frangible portion is less than a thickness of the tube wall over any section of the outer tube portion and the inner tube portion.

4. A dip tube as claimed in claim 3 wherein the frangible portion includes an annular groove extending radially inwardly into the tube wall from the exterior surface of the tube wall toward the interior surface.

5. A dip tube as claimed in claim 4 wherein the tubular member extending from the innermost inlet end to the outlet end along a center axis.

6. A dip tube as claimed in claim 5 wherein the annular groove extends circumferentially about the tubular member.

7. A dip tube as claimed in claim 5 wherein:

the annular groove is disposed in a groove plane intersecting the center axis forming an acute angle of at least 75 degrees with the center axis.

8. A dip tube as claimed in claim 5 including:

an axially inwardly directed touchdown foot surface carried at the innermost inlet end, the touchdown foot surface being disposed asymmetrically about the center axis spaced on a radial side from the center axis over a limited circumferential extent of the center axis, the touchdown foot surface located spaced farther axially inwardly than other surfaces of the tubular member, whereby if axial forces are applied axially parallel the center axis that urge the touch down foot surface into a surface, the axial forces are be transferred asymmetrically to the tubular member attempting to deflect the tubular member radially away from the radial side and assisting in creating the threshold tension forces over the frangible portion on a side of the tubular member opposite the radial side.

9. A dip tube as claimed in claim 5, the first inlet opening at the innermost inlet end on the inner tube portion lies in a first inlet plane intersecting with the center axis forming an acute angle with the center axis.

10. A dip tube as claimed in claim 1 comprising an integral element of plastic material.

11. A dip tube as claimed in claim 1 wherein:

while the frangible portion is intact, the tubular member including each of the outer tube portion, the frangible portion while intact, and an inner tube portion, is rigid and resists deflection and compression, and after the frangible portion is broken, (a) the outer tube portion is rigid and resists deflection and compression, (b) the inner tube portion is rigid and resists deflection and compression, and (c) either (1) the inner tube portion is severed from the outer tube portion or (2) the inner tube portion is hingedly connected to the outer tube portion by a hinge-like connection section of the frangible portion permitting the inner tube portion to pivot relative the outer tube portion about the hinge-like connection section.

12. A dip tube as claimed in claim 1 wherein the inner tube portion is open at a first inlet opening at the innermost inlet end.

13. A dip tube as claimed in claim 1 wherein the inner tube portion is closed at a closed blind end at the innermost inlet end.

14. A dip tube as claimed in claim 12 further comprising an axially innermost plug member and an intermediate annular frangible bridge member bridging between the tubular member and the plug member, the plug member extending from an axially innermost plug touchdown end to an axially outer plug outer end, the plug member having an exterior surface extending between the plug touchdown end and the plug outer end, with the frangible bridge member intact, the frangible bridge member coupling the tubular member and the plug member with the plug touchdown end of the plug member disposed axially inwardly of the innermost inlet end, the frangible bridge member spanning between the tubular member and the exterior surface of the plug member with the frangible bridge member and the plug member sealably closing the first inlet opening, the frangible bridge member selected such that while the frangible bridge member is intact, on application of a threshold compression force to the plug touchdown end of the plug member urging the plug axially outwardly relative the tubular member and across the frangible bridge member, the frangible bridge member breaks and the plug member is displaced axially outwardly via the inlet opening into the passageway opening the first inlet opening for passage of fluid axially inwardly therethrough, the threshold compression force selected to provide for breaking of the frangible bridge member without applying sufficient forces to create the threshold tension force.

15. A dip tube as claimed in in claim 1 wherein the frangible portion extends circumferentially about the tubular member.

16. A dip tube as claimed in claim 1 wherein the tubular member extending from the innermost inlet end to the outlet end along a center axis including:

an axially inwardly directed touchdown foot surface carried at the innermost inlet end, the touchdown foot surface being disposed asymmetrically about the center axis spaced on a radial side from the center axis over a limited circumferential extent of the center axis, the touchdown foot surface located spaced farther axially inwardly than other surfaces of the tubular member, whereby if axial forces are applied axially parallel the center axis that urge the touch down foot surface into a surface, the axial forces are be transferred asymmetrically to the tubular member attempting to deflect the tubular member radially away from the radial side and assisting in creating the threshold tension forces over the frangible portion on a side of the tubular member opposite the radial side.

17. A dip tube as claimed in claim 1 wherein the tubular member extending from the innermost inlet end to the outlet end along a center axis, the first inlet opening at the innermost inlet end on the inner tube portion lies in a first inlet plane intersecting with the center axis forming an acute angle with the center axis.

18. A dip tube as claimed in claim 7 wherein the tubular member extending from the innermost inlet end to the outlet end along a center axis, the first inlet opening at the innermost inlet end on the inner tube portion lies in a first inlet plane intersecting with the center axis forming an acute angle with the center axis.

19. A dip tube comprising an elongate hollow tubular member, an axially innermost plug member and an intermediate annular frangible bridge member bridging between the tubular member and the plug member, the tubular member extending from an innermost inlet end to an outlet end, the tubular member having an outlet opening at the outlet end and an inlet opening at the innermost inlet end, the tubular member defining a sealed continuous interior passageway through the tubular member between the outlet opening at the outlet end and the inlet opening at the innermost inlet end, the plug member extending from an axially innermost plug touchdown end to an axially outer plug outer end, the plug member having an exterior surface extending between the plug touchdown end and the plug outer end, with the frangible bridge member intact, the frangible bridge member coupling the tubular member and the plug member with the plug touchdown end of the plug member disposed axially inwardly of the innermost inlet end on the tubular member, the frangible bridge member spanning between an interior surface of the tubular member and the exterior surface of the plug member with the frangible bridge member and the plug member sealably closing the inlet opening, the frangible bridge member selected such that while the frangible bridge member is intact, on application of a threshold compression force to the plug touchdown end of the plug member urging the plug axially outwardly relative the tubular member and across the frangible bridge member, the frangible bridge member breaks and the plug member is displaced axially outwardly via the inlet opening into the passageway opening the inlet opening for passage of fluid axially inwardly therethrough.

20. A dip tube as claimed in claim 1 in combination with a fluid pump and a reservoir, the reservoir having an interior cavity bounded by side walls and a bottom wall and open upwardly from the side walls at an open reservoir upper opening, the side walls closed at a lower end by the bottom wall, the side walls having an interior side wall surface, the bottom wall having an upwardly directed interior bottom surface, the fluid pump having a pump intake conduit to draw fluid into the pump for discharge from a pump discharge outlet, a pump assembly comprising the dip tube coupled to the pump with the outlet end of the dip tube fixedly secured to the to the pump intake conduit in a fluid sealed relation, a locating mechanism to locate the pump assembly in a desired pumping position relative the reservoir for operation of the pump, in the desired pumping position with the frangible portion broken, the dip tube extends into the reservoir cavity through the reservoir upper opening downwardly from the outlet end of the dip tube towards the upwardly directed interior bottom surface of the bottom wall a desired extent placement of the intermediate inlet opening proximate the bottom surface for operation of the pump to draw fluid from the reservoir via the dip tube, an inoperative position in the pump assembly is located relative the reservoir above the desired pumping position with the dip tube with the frangible portion intact extending downwardly into the reservoir through the reservoir upper opening from the outlet end of the dip tube to locate the inlet end of the dip tube within the reservoir engaged with the upwardly directed interior bottom surface of the bottom wall, with downward movement relative the reservoir of the pump assembly from the inoperative position to the desired pumping position, the inlet end of the dip tube and the upwardly directed interior bottom surface of the bottom wall engage producing the tension force between the inner tube portion and the outer tube portion across the frangible portion sufficient to break the frangible portion, in the desired pumping position with the frangible portion broken, the pump is operative to draw fluid from the reservoir directly into the second inlet opening at the intermediate inlet end on the outer tube portion and merely through the continuous shorter interior passageway.

* * * * *